US009015053B2

(12) United States Patent
Suzuki et al.

(10) Patent No.: US 9,015,053 B2
(45) Date of Patent: Apr. 21, 2015

(54) AUDIO CODING DEVICE AND AUDIO CODING METHOD, AUDIO DECODING DEVICE AND AUDIO DECODING METHOD, AND PROGRAM

(75) Inventors: Shiro Suzuki, Kanagawa (JP); Yuuki Matsumura, Saitama (JP); Yasuhiro Toguri, Kanagawa (JP); Yuuji Maeda, Tokyo (JP); Jun Matsumoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 418 days.

(21) Appl. No.: 13/616,682

(22) Filed: Sep. 14, 2012

(65) Prior Publication Data

US 2013/0096927 A1 Apr. 18, 2013

(30) Foreign Application Priority Data

Sep. 26, 2011 (JP) ..... 2011-209101

(51) Int. Cl.
*G10L 19/00* (2013.01)
*G10L 19/008* (2013.01)
*G10L 19/022* (2013.01)

(52) U.S. Cl.
CPC ..... *G10L 19/008* (2013.01); *G10L 19/022* (2013.01)

(58) Field of Classification Search
USPC ..... 704/500–504
See application file for complete search history.

(56) References Cited

U.S. PATENT DOCUMENTS

| | | | | |
|---|---|---|---|---|
| 5,285,498 | A * | 2/1994 | Johnston | 381/2 |
| 5,394,473 | A * | 2/1995 | Davidson | 704/200.1 |
| 5,848,391 | A * | 12/1998 | Bosi et al. | 704/200.1 |
| 6,904,404 | B1 * | 6/2005 | Norimatsu et al. | 704/222 |
| 2001/0029456 | A1 * | 10/2001 | Shioda et al. | 704/500 |
| 2004/0098268 | A1 * | 5/2004 | Ha | 704/500 |
| 2006/0173675 | A1 * | 8/2006 | Ojanpera | 704/203 |
| 2009/0198501 | A1 * | 8/2009 | Jeong et al. | 704/500 |
| 2012/0022881 | A1 * | 1/2012 | Geiger et al. | 704/504 |
| 2013/0096927 | A1 * | 4/2013 | Suzuki et al. | 704/500 |

FOREIGN PATENT DOCUMENTS

JP 2906483 4/1999

* cited by examiner

*Primary Examiner* — Samuel G Neway
(74) *Attorney, Agent, or Firm* — Finnegan, Henderson, Farabow, Garrett & Dunner, LLP

(57) ABSTRACT

There is provided an audio coding device including a first windowing part that multiplies an audio signal by a first window function, a second windowing part that multiplies the audio signal by a second window function having a characteristic different from a characteristic of the first window function, a window selecting part that selects the first window function or the second window function as an optimum window function based on the audio signal multiplied by the first windowing part and the audio signal multiplied by the second windowing part, a coding part that codes a frequency spectrum of the audio signal multiplied by the optimum window function, and a transmitting part that transmits the frequency spectrum coded by the coding part and window function information representing the optimum window function.

11 Claims, 13 Drawing Sheets

A

B

A

B

AUDIO CODING DEVICE AND AUDIO CODING METHOD, AUDIO DECODING DEVICE AND AUDIO DECODING METHOD, AND PROGRAM

BACKGROUND

The present technology relates to audio coding devices and audio coding methods, audio decoding devices and audio decoding methods, and programs. More particularly the present technology relates to an audio coding device and an audio coding method, an audio decoding device and an audio decoding method, and a program capable of coding audio signals by adaptively-using a higher suitable window function.

As the coding method of audio signal, generally, MP3 (Moving Picture Experts Group Audio Layer-3), AAC (Advanced Audio Coding), ATRAC (Adaptive Transform Acoustic Coding) or the like are well-known as conversion coding methods.

As the audio coding device for coding audio signals, there is known a device which divides an audio signal into plural bands and then performs orthogonal transformation and quantization on a band basis (for example, refer to Japanese Patent No. 2906483).

FIG. 1 is a block diagram showing an example of a configuration of an audio coding device which codes audio signals.

An audio coding device 10 shown in FIG. 1 is configured including a windowing part 11, a frequency converting part 12, a normalization coefficient determining part 13, a normalization coefficient coding part 14, a normalizing part 15, a quantizing part 16, a coding part 17 and a multiplexing part 18.

The audio coding device 10 receives an audio signal T of a PCM (Pulse Code Modulation) signal, which is a piece of frame data T[J] and is segmented into specific sections called as frames. The audio coding device 10 codes the frame data T[J]. J here is an index attached to each of the frames from the front frame in order.

The windowing part 11 of the audio coding device 10 multiplies the input frame data T[J] by a window function WF, and supplies a resultant multiplied data WFT[J] to the frequency converting part 12. The frequency converting part 12 performs a frequency conversion on the multiplied data WFT[J] supplied from the windowing part 11 to obtain a frequency spectrum SP[J]. The frequency converting part 12 supplies the frequency spectrum SP[J] to the normalization coefficient determining part 13 and the normalizing part 15.

The normalization coefficient determining part 13 determines a normalization coefficient SF[J] representing an outline (hereinafter, referred to as envelope) of the frequency spectrum SP[J] based on the frequency spectrum SP[J] supplied from the frequency converting part 12, and supplies the same to the normalization coefficient coding part 14 and the normalizing part 15.

The normalization coefficient coding part 14 calculates a bit number NSF[J] necessary for coding the normalization coefficient SF[J] supplied from the normalization coefficient determining part 13, and supplies the same to the quantizing part 16. Also, the normalization coefficient coding part 14 performs a coding of the normalization coefficient SF[J], and supplies a resultant coded normalization coefficient HSF[J] to the multiplexing part 18.

The normalizing part 15 normalizes the frequency spectrum SP[J] supplied from the frequency converting part 12 by using the normalization coefficient SF[J] supplied from the normalization coefficient determining part 13, and supplies a resultant normalized spectrum NSP[J] to the quantizing part 16.

The quantizing part 16 quantizes the normalized spectrum NSP[J] supplied from the normalizing part 15 based on a piece of quantization information P[J] representing a quantization bit number as a quantization accuracy, and supplies a resultant quantization spectrum QSP[J] to the coding part 17. At this time, the quantizing part 16 obtains a bit number NQSP[J] fed back from the coding part 17 corresponding to the quantization spectrum QSP[J], and adjusts the quantization information P[J] so that the bit number NQSP[J] becomes a predetermined value. The quantizing part 16 supplies the adjusted quantization information P[J] to the multiplexing part 18.

The coding part 17 calculates a bit number NQSP[J] necessary for coding the quantization spectrum QSP[J] supplied from the quantizing part 16. Here, when the bit number NB[J] of a code string B[J], which will be described bellow, is predetermine, the bit number NQSP[J] is necessary to be a value NQ or less in which the bit number NB[J] is subtracted by the bit number NSF[J] relevant to the bit number NP[J] of the quantization information P[J] and the coding of the normalization coefficient SF[J]. Therefore, the coding part 17 feeds the bit number NQSP[J] back to the quantizing part 16, and the quantizing part 16 adjusts the quantization information P[J] so that the bit number NQSP[J] is the value NQ or less. Also, the coding part 17 codes the quantization spectrum QSP[J], and supplies the resultant coded spectrum HSP[J] to the multiplexing part 18.

The multiplexing part 18 multiplexes the coded normalization coefficient HSF[J] from the normalization coefficient coding part 14, the quantization information P[J] from the quantizing part 16 and the coded spectrum HSP[J] from the coding part 17, and transmits the resultant code string B[J].

FIG. 2 is a block diagram showing an example of a configuration of the audio decoding device for decoding the code string B[J] transmitted from the audio coding device 10 shown in FIG. 1.

An audio decoding device 30 shown in FIG. 2 is configured including a decomposing part 31, a decoding part 32, an inverse quantizing part 33, a normalization coefficient decoding part 34, an inverse normalizing part 35, an inverse frequency converting part 36, a windowing part 37 and overlapping part 38.

The decomposing part 31 in the audio decoding device 30 decomposes the code string B[J] transmitted from the audio coding device 10, shown in FIG. 1, into the coded spectrum HSP[J], the quantization information P[J] and the coded normalization coefficient HSF[J]. The decomposing part 31 supplies the coded spectrum HSP[J] to the decoding part 32, the quantization information P[J] to the inverse quantizing part 33, and the coded normalization coefficient HSF[J] to the normalization coefficient decoding part 34.

The decoding part 32 decodes the coded spectrum HSP[J] supplied from the decomposing part 31, and supplies a resultant quantization spectrum QSP[J] to the inverse quantizing part 33. The inverse quantizing part 33 performs an inverse quantization on the quantization spectrum QSP[J] supplied from the decoding part 32 based on the quantization information P[J] supplied from the decomposing part 31 to obtain a normalized spectrum NSP[J]. The inverse quantizing part 33 supplies the normalized spectrum NSP[J] to the inverse normalizing part 35.

The normalization coefficient decoding part 34 decodes the coded normalization coefficient HSF[J] supplied from the decomposing part 31, and supplies a resultant normalization coefficient SF[J] to the inverse normalizing part 35. The inverse normalizing part 35 performs an inverse normalization by using the normalization coefficient SF[J] supplied from the normalization coefficient decoding part 34 and the normalized spectrum NSP[J], and supplies the resultant frequency spectrum SP[J] to the inverse frequency converting part 36.

The inverse frequency converting part 36 performs an inverse frequency conversion on the frequency spectrum SP[J] supplied from the inverse normalizing part 35, and supplies a resultant time axis data ST[J] to the windowing part 37.

The windowing part 37 multiplies the time axis data ST[J] supplied from the inverse frequency converting part 36 by a window function WB. The relationship between the window function WF in the windowing part 11 shown in FIG. 1 and the window function WB has a following restraint condition. That is, when the quantization bit number is infinite (quantization accuracy is infinite), the frame data T[J], which will be described bellow, input to the audio coding device 10 and the frame data T[J] output from the audio decoding device 30 coincide with each other. The windowing part 37 supplies the multiplied data WBT[J] obtained as a result of multiplication to the overlapping part 38.

The overlapping part 38 holds the multiplied data WBT[J] supplied from the windowing part 37. Also, the overlapping part 38 adds the multiplied data WBT[J−1] of a held frame of index J−1 and the multiplied data WBT[J] while overlapping with each other, for example, by a half of one frame. The overlapping part 38 outputs the resultant frame data T[J] as a decoding result. Note that, in order to simplify the description, the frame data as the decoding result is represented with T[J] here, which is the same as the frame data before coding. However, actually, the decoding result and the frame data before coding are not identical.

In the audio coding device 10 shown in FIG. 1, when the ratio of the bit number NSF[J] necessary for coding of the normalization coefficient SF[J] gets larger with respect to the bit number NB[J] of the code string B[J], the bit number NQSP[J] available for the coding of the frequency spectrum SP[J] gets smaller. As a result, the quantization accuracy of the frequency spectrum SP[J] may decrease resulting in a deterioration of sound quality.

Therefore, by reducing the number of the coding frequency spectrums SP[J], the bit number NQSP[J] can be reduced without deteriorating the quantization accuracy of the frequency spectrum SP[J] to thereby prevent the deterioration of sound quality.

When reducing the number of the coding frequency spectrum SP[J], generally high-pass frequency spectrums SP[J] are mainly reduced. In this case, the sound as the decoding result may result in a sound without high-pass elements; i.e., so called boxy sound. Also, it is well known that, when the number of the frequency spectrums SP[J] which are coded on a frame-basis changes, the change may cause a deterioration of sound quality.

On the other hand, it is known that, even when the identical frame data T[J] is input to the audio coding device 10, the bit number NSF[J] which relates to the coding of the normalization coefficient SF[J] and quantization error is changed depending on the configuration of the window function WF.

SUMMARY

Therefore, it is desired to reduce the deterioration of sound quality by reducing the bit number NSF[J] and/or enhancing the quantization accuracy by coding the audio signal using a more suitable window function.

The present technology has been proposed in view of the above circumstances. The present technology enables to code the audio signal adaptively using a more suitable window function.

According to a first embodiment of the present technology, there is provided an audio coding device, including a first windowing part that multiplies an audio signal by a first window function, a second windowing part that multiplies the audio signal by a second window function having a characteristic different from a characteristic of the first window function, a window selecting part that selects the first window function or the second window function as an optimum window function based on the audio signal multiplied by the first windowing part and the audio signal multiplied by the second windowing part, a coding part that codes a frequency spectrum of the audio signal multiplied by the optimum window function, and a transmitting part that transmits the frequency spectrum coded by the coding part and window function information representing the optimum window function.

The audio coding method and program of the first embodiment of the present technology corresponds to the audio coding device of a first embodiment of the present technology.

In the first embodiment of the present technology, the audio signal is multiplied by the first window function, the audio signal is multiplied by the second window function which has a characteristic different from that of the first window function, the first window function or the second window function is selected as the optimum window function based on the audio signal multiplied by the first window function and the audio signal multiplied by the second window function, the frequency spectrum of the audio signal multiplied by the optimum window function is coded, and the coded frequency spectrum and a piece of window function information representing the optimum window function are transmitted.

According to a second embodiment of the present technology, there is provided an audio decoding device, including a receiving part that receives a coded spectrum which is obtained as a result of coding a frequency spectrum of an audio signal multiplied by a first window function or a second window function having a characteristic different from a characteristic of the first window function as an optimum window function, and window function information representing the first window function or the second window function as the optimum window function, a decoding part that decodes the coded spectrum received by the receiving part, a window selecting part that selects the optimum window function from the first window function and the second window function based on the window function information received by the receiving part, and a windowing part that generates the audio signal from an audio signal of the frequency spectrum obtained as a result of decoding performed by the decoding part based on the optimum window function selected by the window selecting part.

The audio decoding method and program of a second embodiment of the present technology corresponds to the audio decoding device of the second embodiment of the present technology.

In the second a embodiment of the present technology, the coded spectrum obtained as a coding result of the frequency spectrum of the audio signal multiplied by the first window function or the second window function having a characteristic different from the first window function as the optimum window function and a piece of window function information representing the first window function or the second window function as the optimum window function are received, the received coded spectrum is decoded, the optimum window function is selected from the first window function or the second window function based on the received window function information, the audio signal is generated from the audio signal of the frequency spectrum obtained as the decoding result based on the selected optimum window function.

According to the first embodiment of the present technology, it is possible to code the audio signal by adaptively using a more appropriate window function.

According to the second embodiment of the present technology, it is possible to decode the coded audio signal by adaptively using a more appropriate window function.

DETAILED DESCRIPTION OF THE EMBODIMENT(S)

Figure 1:
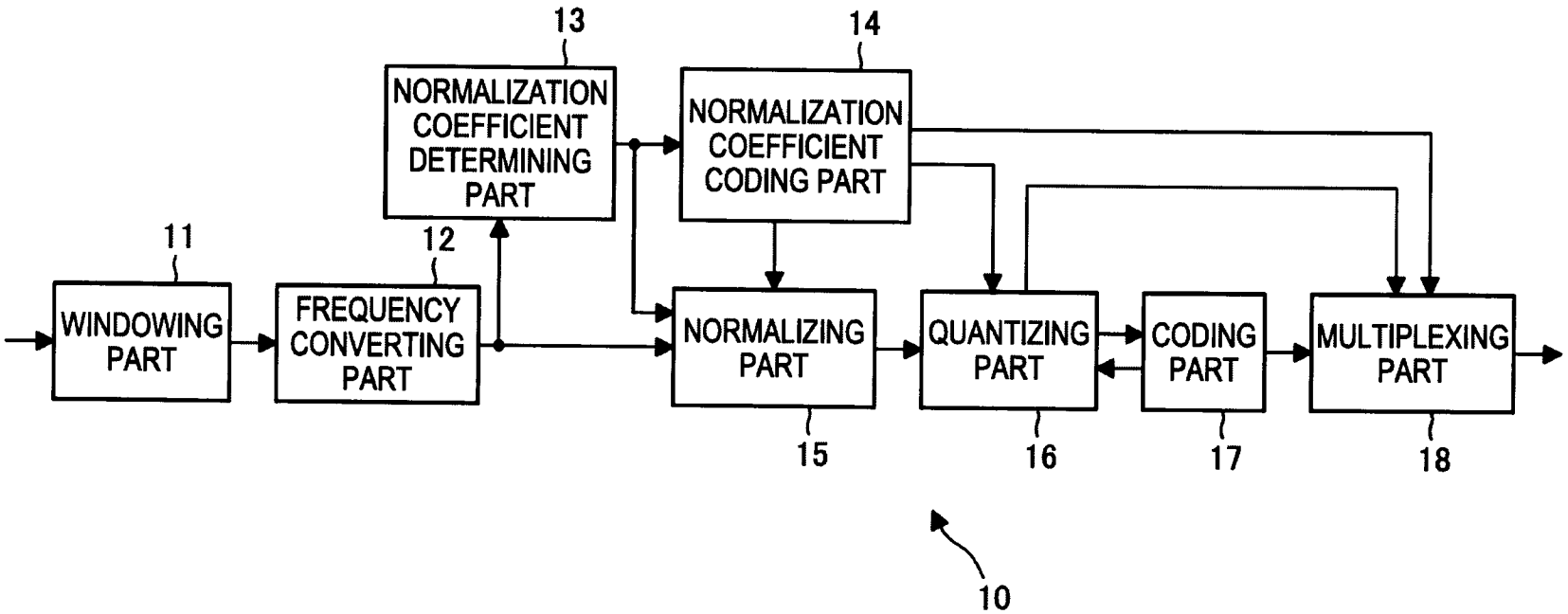
FIG. 1 is a block diagram showing an example of a configuration of an audio coding device which codes audio signals.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

First Embodiment

Configuration Example of a First Embodiment of Audio Coding Device

Figure 3:
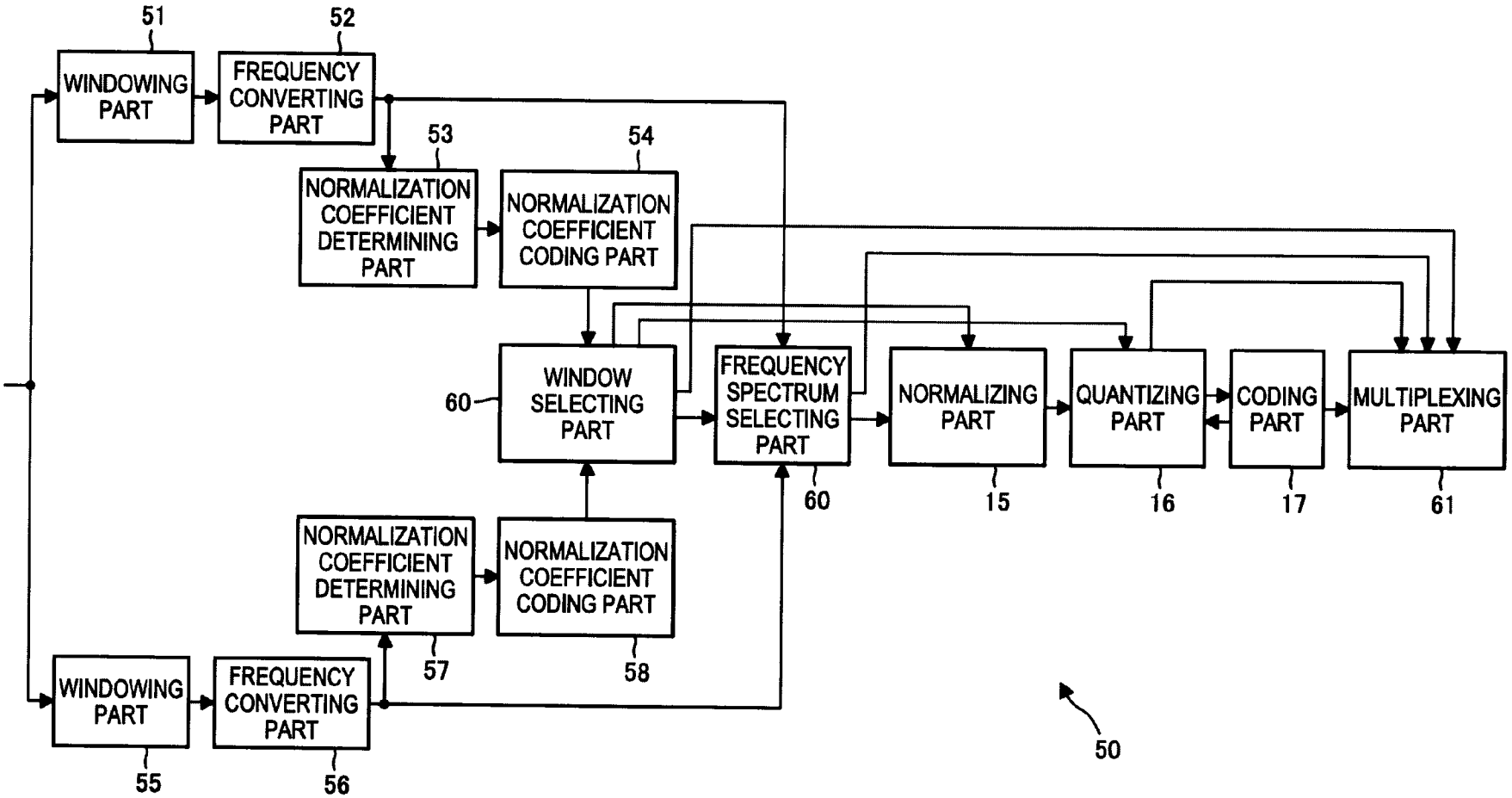
FIG. 3 is a block diagram showing a configuration example of a first embodiment of an audio coding device to which the present technology is applied.

FIG. 3 is a block diagram showing a configuration example of a first embodiment of audio coding device to which the present technology is applied.

In the configuration shown in FIG. 3, the same elements as the elements shown in FIG. 1 are given with the same numerals. Duplicated descriptions will be omitted appropriately.

The configuration of an audio coding device 50 shown FIG. 3 is different from the configuration shown in FIG. 1 in a point that windowing part 51 and 55, frequency converting parts 52 and 56, normalization coefficient determining parts 53 and 57, normalization coefficient coding parts 54 and 58 and a multiplexing part 61 are provided in place of the windowing part 11, the frequency converting part 12, the normalization coefficient determining part 13, the normalization coefficient coding part 14 and the multiplexing part 18 in the configuration shown in FIG. 1; and in a point that a window selecting part 59 and a frequency spectrum selecting part 60 are newly provided thereto.

The audio coding device 50 multiplies the frame data T[J] by a window function WF1 and a window function WF2, each of which has a characteristic different from each other. And the audio coding device 50 selects a window function with which an optimum coding efficiency of the normalization coefficient is obtained as the optimum window function based on the bit number necessary for coding the normalization coefficient of the frequency spectrum, which is obtained by performing a frequency conversion on the resultant multiplied data.

In particular, in the audio coding device 50, the path 1 including the windowing part 51, the frequency converting part 52, the normalization coefficient determining part 53 and the normalization coefficient coding part 54 is for obtaining a frequency spectrum SP1[J] of the frame data T[J], which is multiplied by the window function WF1, and a coded normalization coefficient HSF1[J].

In more particularly, the windowing part 51 multiplies the input frame data T[J] by the window function WF1, and supplies a resultant multiplied data WFT1[J] to the frequency converting part 52. The frequency converting part 52 performs a frequency conversion on the multiplied data WFT1[J] supplied from the windowing part 51 to obtain the frequency spectrum SP1[J]. The frequency converting part 52 supplies the frequency spectrum SP1[J] to the normalization coefficient determining part 53 and the frequency spectrum selecting part 60.

The normalization coefficient determining part 53 determines the normalization coefficient SF1[J] of the frequency spectrum SP1[J] from the frequency spectrum SP1[J] supplied from the frequency converting part 52, and supplies the same to the normalization coefficient coding part 54.

The normalization coefficient coding part 54 calculates a bit number NSF1[J] necessary for coding of the normalization coefficient SF1[J] supplied from the normalization coefficient determining part 53, and supplies the same to the window selecting part 59. Also, the normalization coefficient coding part 54 codes the normalization coefficient SF1[J], and supplies the resultant coded normalization coefficient HSF1[J] and the normalization coefficient SF1[J] to the window selecting part 59.

A path 2 including the windowing part 55, the frequency converting part 56, the normalization coefficient determining part 57 and the normalization coefficient coding part 58 is configured same as the path 1 for obtaining frequency spectrum SP2[J] of the frame data T[J], which is multiplied by the window function WF2, and a coded normalization coefficient HSF2[J].

In particular, the windowing part 55 multiplies the input frame data T[J] by the window function WF2, and supplies the resultant multiplied data WFT2[J] to the frequency converting part 56. The frequency converting part 56 performs a frequency conversion on the multiplied data WFT2[J] supplied from the windowing part 55 to obtain the frequency spectrum SP2[J]. The frequency converting part 56 supplies the frequency spectrum SP2[J] to the normalization coefficient determining part 57 and the frequency spectrum selecting part 60.

The normalization coefficient determining part 57 determines the normalization coefficient SF2[J] of the frequency spectrum SP2[J] from the frequency spectrum SP2[J] supplied from the frequency converting part 56, and supplies the same to the normalization coefficient coding part 58.

The normalization coefficient coding part 58 calculates a bit number NSF2[J] necessary for coding of the normalization coefficient SF2[J] supplied from the normalization coefficient determining part 57, and supplies the same to the window selecting part 59. Also, the normalization coefficient coding part 58 codes the normalization coefficient SF2[J], and supplies the resultant coded normalization coefficient HSF2[J] and the normalization coefficient SF2[J] to the window selecting part 59.

The window selecting part 59 compares bit number NSF1[J] supplied from the normalization coefficient coding part 54 and the bit number NSF2[J] supplied from the normalization coefficient coding part 58, and selects a window function corresponding to the smaller one as the optimum window function. When the bit number NSF1[J] and the bit number NSF2[J] are identical to each other, the window selecting part 59 selects either one of the window function WF1 and the window function WF2.

When the window function WF1 is selected, the window selecting part 59 determines the coded normalization coefficient HSF1[J] supplied from the normalization coefficient coding part 54 as the coded normalization coefficient HSF[J]; the normalization coefficient SF1[J] as the normalization coefficient SF[J]; and the bit number NSF1[J] as the bit number NSF[J]. The window selecting part 59 generates a window function information SW[J] representing the selected window function WF1 as the optimum window function, and supplies the same to the frequency spectrum selecting part 60.

On the other hand, when the window function WF2 is selected, the window selecting part 59 determines the coded normalization coefficient HSF2[J] supplied from the normalization coefficient coding part 54 as the coded normalization coefficient HSF[J]; the normalization coefficient SF2[J] as the normalization coefficient SF[J]; and the bit number NSF2[J] as the bit number NSF[J]. Also, the window selecting part 59 generates the window function information SW[J] representing the selected window function WF2 as the optimum window function, and supplies the same to the frequency spectrum selecting part 60. Here, it is assumed that the window function information SW[J] representing the window function WF1 is 0, and the window function information SW[J] representing the window function WF2 is 1.

The window selecting part 59 supplies the coded normalization coefficient HSF[J] to the multiplexing part 61; the normalization coefficient SF[J] to the normalizing part 15; and the bit number NSF[J] to the quantizing part 16.

The frequency spectrum selecting part 60 selects the frequency spectrum SP1[J] supplied from the frequency converting part 52 or the frequency spectrum SP2[J] supplied from the frequency converting part 56 based on the window function information SW[J] supplied from the window selecting part 59. The frequency spectrum selecting part 60 supplies the selected frequency spectrum SP1[J] or the frequency spectrum SP2[J] to the normalizing part 15 as the frequency spectrum SP[J]. Also, the frequency spectrum selecting part 60 supplies the window function information SW[J] to the multiplexing part 61.

The multiplexing part 61 multiplexes the coded normalization coefficient HSF[J] from the window selecting part 59, the window function information SW[J] from the frequency spectrum selecting part 60, the quantization information P[J] from the quantizing part 16 and the coded spectrum HSP[J] from the coding part 17. The multiplexing part 61 functions as a transmitting part to control the transmission of the code string B[J] obtained as a result of the multiplex and transmit the code string B[J].

[Example of Window Function WF1]

Figure 4:
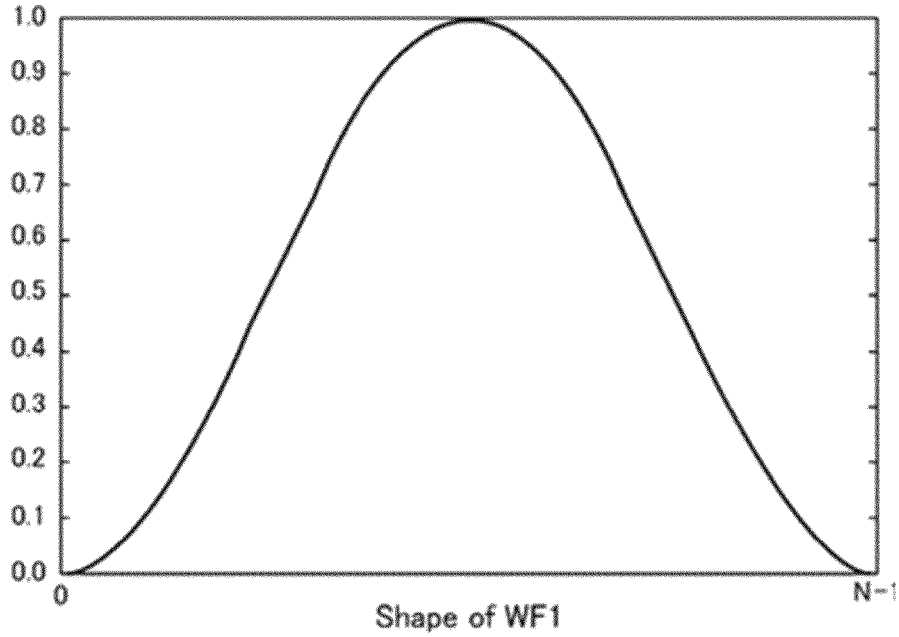
FIG. 4 illustrates an example of a window function WF1.
Figure 4:
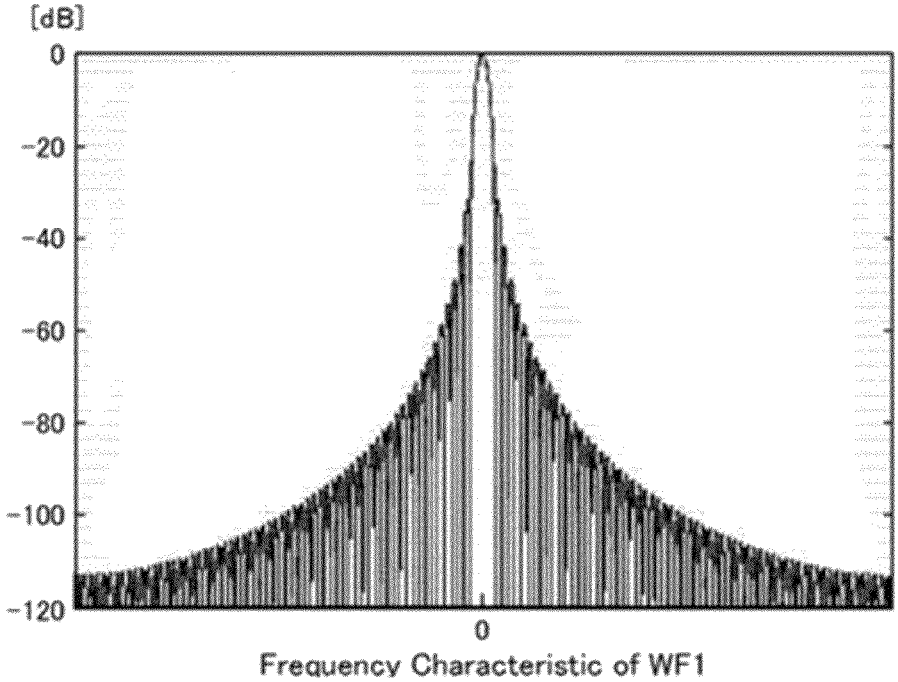

FIG. 4 illustrates an example of the window function WF1.

FIG. 4A represents the window function WF1 with the sample number N; FIG. 4B represents the frequency characteristic of the window function WF1 with the sample number N. In FIG. 4A, the horizontal axis represents an index for each sample; and the vertical axis represents the magnitude of the window function WF1. In FIG. 4B, the horizontal axis represents the frequency having the central frequency 0, the range thereof is from $-\pi$ to $+\pi$ on a radian basis. The vertical axis represents the level [dB] of the frequency characteristic.

The frequency characteristic of the window function WF1 as shown in FIG. 4A has a characteristic in which the level of the central frequency sharply protrudes as shown FIG. 4B. Therefore, the window function WF1 is a window function having a higher frequency resolution.

[Example of Window Function WF2]

Figure 5:
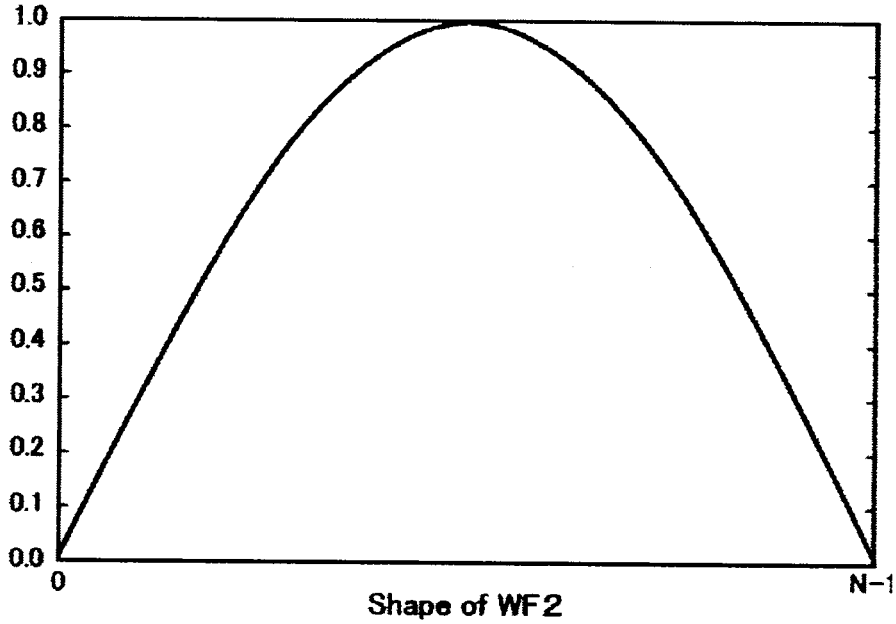
FIG. 5 illustrates an example of a window function WF2.
Figure 5:
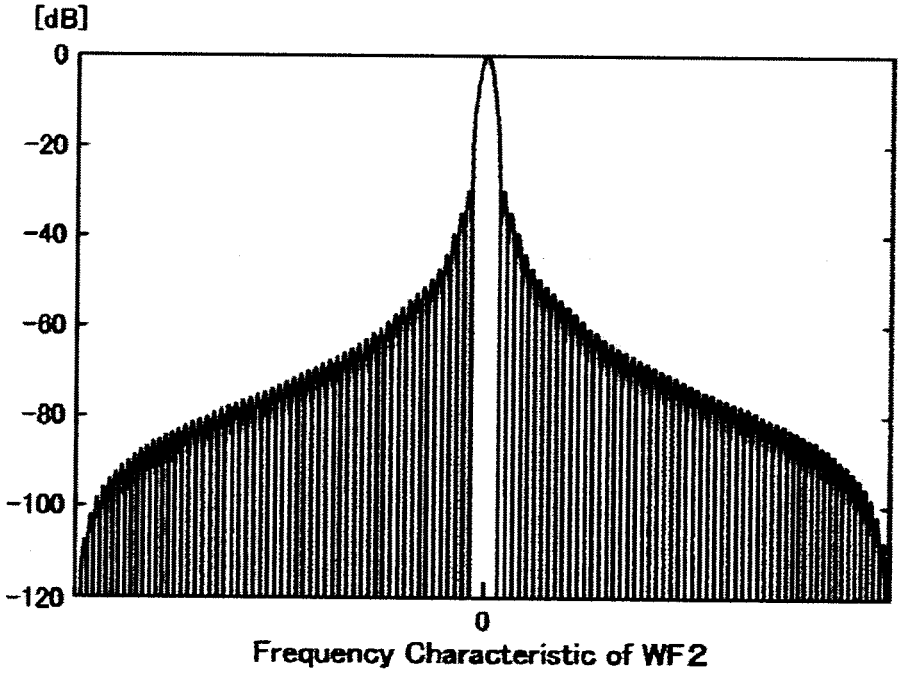

FIG. 5 illustrates an example of the window function WF2.

FIG. 5A represents the window function WF2 with the sample number N; FIG. 5B represents the frequency characteristic of the window function WF2 with the sample number N. In FIG. 5A, the horizontal axis represents an index for each sample; and the vertical axis represents the magnitude of the window function WF2. In FIG. 5B, the horizontal axis represents the frequency having the central frequency 0, the range thereof is from $-\pi$ to $+\pi$ on a radian basis. The vertical axis represents the level [dB] of the frequency characteristic.

The frequency characteristic of the window function WF2 as shown in FIG. 5A has a characteristic in which, compared to FIG. 4, the level of the central frequency does not sharply protrude as shown FIG. 5B. Therefore, the window function WF2 is a window function having a lower frequency resolution.

[Example of Frequency Spectrum]

Figure 6:
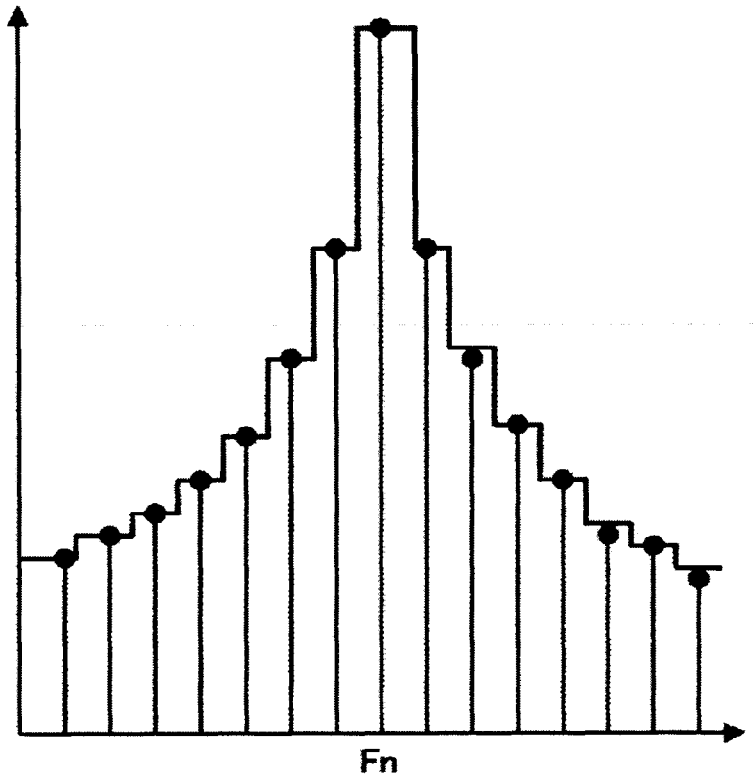
FIG. 6 illustrates an example of a frequency spectrum SP1[J]
Figure 7:
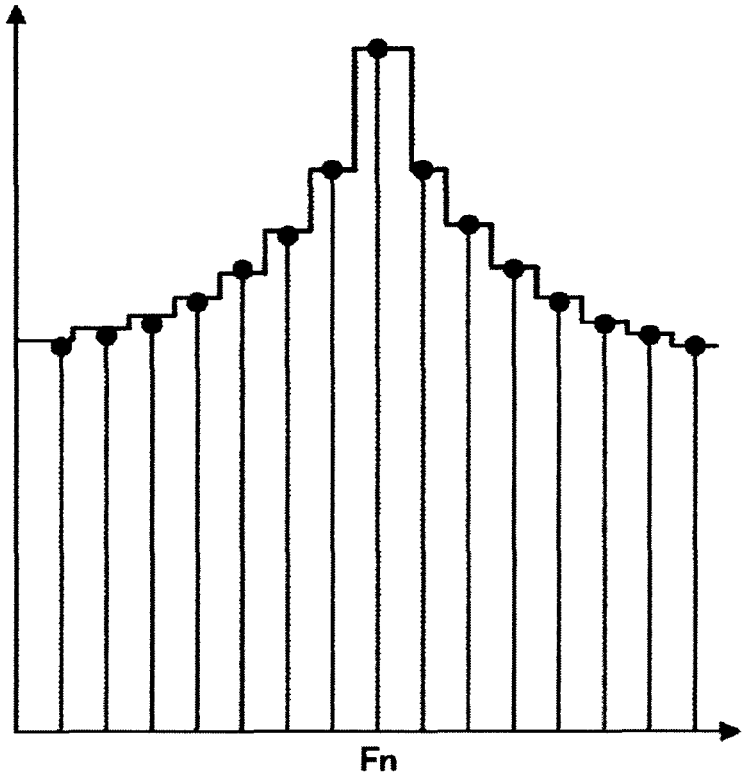
FIG. 7 illustrates an example of a frequency spectrum SP2[J]

FIG. 6 illustrates an example of the frequency spectrum SP1[J]. FIG. 7 illustrates an example of the frequency spectrum SP2[J].

In FIG. 6 and FIG. 7, the horizontal axis represents the frequency index; and the vertical axis represents the level of the frequency spectrum. Also, in FIG. 6 and FIG. 7, each of the black circles represents the level of the frequency spectrum of each frequency index; and the broken line represents the normalization coefficient.

In the example in FIG. 6 and FIG. 7, for the purpose of simplifying the description, the normalization coefficient is determined for each frequency spectrum of the frequency index. However, generally one normalization coefficient is determined for several frequency spectrums.

Since the window function WF1 is the window function which has a higher frequency resolution, when the frame data T[J] is an audio signal having a higher tone (in the example of FIG. 6, sinusoidal signal of the frequency Fn), the energy of the frequency spectrum SP1[J] converges to the frequency spectrum of the frequency index Fn as shown in FIG. 6. That is, in the envelope of the frequency spectrum SP1[J], the frequency spectrum of the frequency index Fn protrudes sharply. Therefore, in the normalization coefficient SF1[J] representing the envelope of the frequency spectrum SP1[J], the normalization coefficient SF1[J] of the frequency index Fn largely protrudes.

On the other hand, since the window function WF2 is a window function with a lower frequency resolution, the frequency spectrum SP2[J] disperse entirely as shown in FIG. 7. That is, compared to the envelope of the frequency spectrum SP1[J], in the envelope of the frequency spectrum SP2[J], the protrusion of the frequency spectrum of the frequency index Fn does not sharply protrude. Therefore, comparing to the normalization coefficient SF1[J], in the normalization coefficient SF2[J] of the frequency index Fn, the normalization coefficient SF2[J] representing the envelope of the frequency spectrum SP2[J] is not so large.

Since the envelope of the frequency spectrum changes depending on the characteristic of the window function as described above, the envelope of the normalization coefficient also changes. Therefore, when the coding method of the normalization coefficient is identical, it is possible to change the bit number necessary for coding the normalization coefficient by changing the characteristic of the window function.

For example, in FIG. 6 and FIG. 7, comparing to the normalization coefficient SF2[J], in the normalization coefficient SF1[J], the interproximal difference is large. Therefore, when the normalization coefficient coding part 54 and 58 perform coding on the interproximal difference, there is a high possibility that the bit number NSF2[J] become smaller compared to the normalization coefficient SF2[J].

Accordingly, the audio coding device 50 generates the frequency spectrum by using two different window functions WF1 and WF2 having different characteristic each other, and selects a window function with a smaller bit number necessary for coding the normalization coefficient of the frequency spectrum as the optimum window function. With this, the bit number to be allotted for coding of the frequency spectrum can be increased. As a result, deterioration of sound quality can be reduced.

[Description of Processing of the Audio Coding Device]

Figure 8:
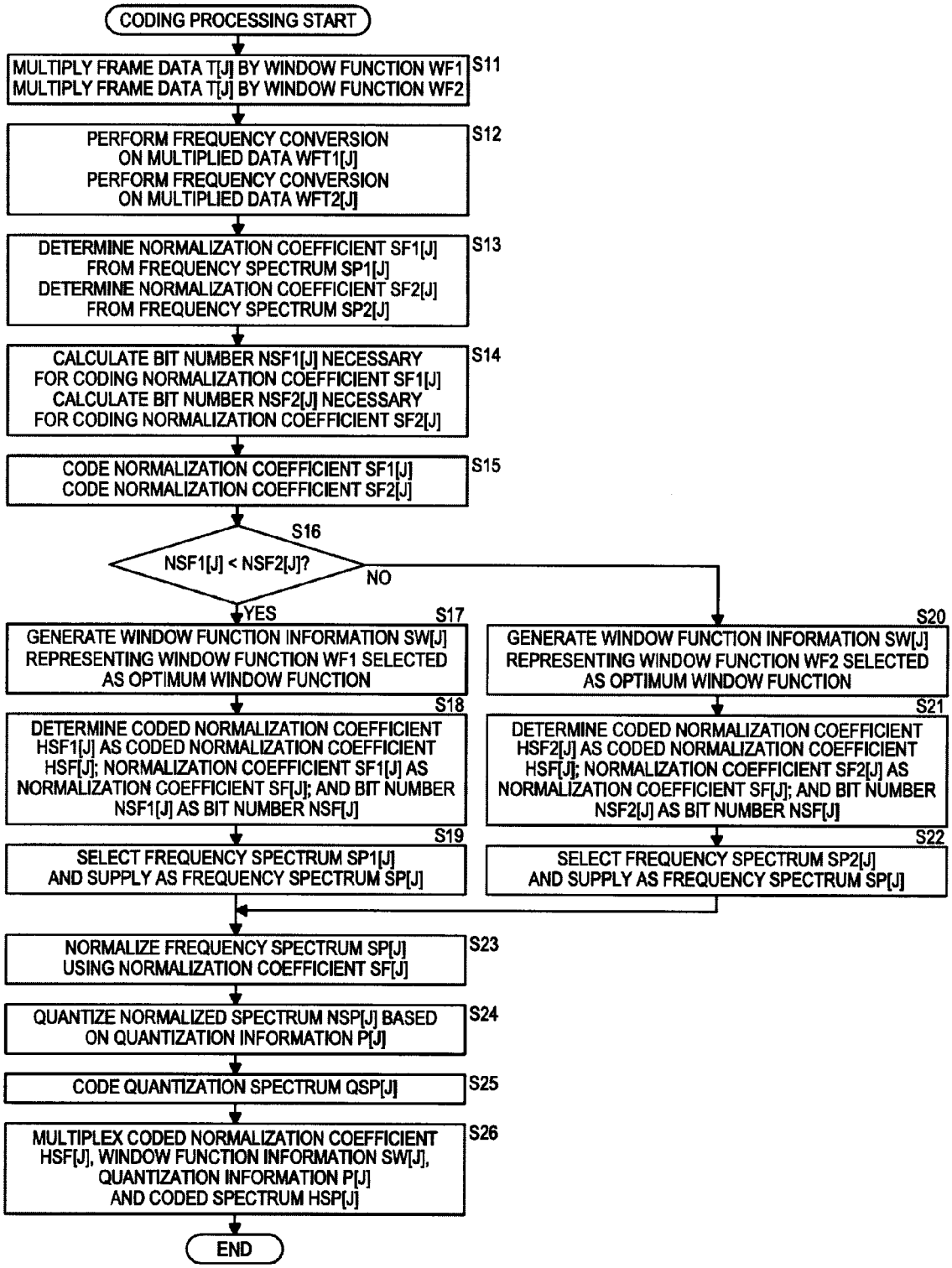
FIG. 8 is a flowchart explaining coding processing by the audio coding device shown in FIG. 3.

FIG. 8 is a flowchart explaining the coding processing of the audio coding device 50 shown FIG. 3. The coding processing starts, for example, when the frame data T[J] is input as a coding object.

Referring to FIG. 8, in step S11, the windowing part 51 multiplies the input frame data T[J] by the window function WF1, and supplies the resultant multiplied data WFT1[J] to the frequency converting part 52. The windowing part 55 also multiplies the input frame data T[J] by the window function WF2, and supplies the resultant multiplied data WFT2[J] to the frequency converting part 56.

In step S12, the frequency converting part 52 performs a frequency conversion on the multiplied data WFT1[J] supplied from the windowing part 51 to obtain the frequency spectrum SP1[J]. The frequency converting part 52 supplies the frequency spectrum SP1[J] to the normalization coefficient determining part 53 and the frequency spectrum selecting part 60. The frequency converting part 56 also performs a frequency conversion on the multiplied data WFT2[J] supplied from the windowing part 55 to obtain the frequency spectrum SP2[J]. The frequency converting part 56 supplies the frequency spectrum SP2[J] to the normalization coefficient determining part 57 and the frequency spectrum selecting part 60.

In step S13, the normalization coefficient determining part 53 determines the normalization coefficient SF1[J] of the frequency spectrum SP1[J] from the frequency spectrum SP1[J] supplied from the frequency converting part 52, and supplies the same to the normalization coefficient coding part 54. The normalization coefficient determining part 57 also determines the normalization coefficient SF2[J] of the frequency spectrum SP2[J] from the frequency spectrum SP2[J] supplied from the frequency converting part 56, and supplies the same to the normalization coefficient coding part 58.

In step S14, the normalization coefficient coding part 54 calculates the bit number NSF1[J] necessary for coding of the normalization coefficient SF1[J] supplied from the normalization coefficient determining part 53, and supplies the same to the window selecting part 59. The normalization coefficient coding part 58 also calculates the bit number NSF2[J] necessary for coding of the normalization coefficient SF2[J] supplied from the normalization coefficient determining part 57, and supplies the same to the window selecting part 59.

In step S15, the normalization coefficient coding part 54 codes the normalization coefficient SF1[J] and supplies the resultant coded normalization coefficient HSF1[J] and the normalization coefficient SF1[J] to the window selecting part 59. The normalization coefficient coding part 58 also codes the normalization coefficient SF2[J] and supplies the resultant coded normalization coefficient HSF2[J] and the normalization coefficient SF2[J] to the window selecting part 59.

In step S16, the window selecting part 59 determines if the bit number NSF1[J] supplied from the normalization coefficient coding part 54 is smaller than the bit number NSF2[J] supplied from the normalization coefficient coding part 58.

When it is determined that the bit number NSF1[J] is smaller than the bit number NSF2[J] in step S16, the window selecting part 59 selects the window function WF1 as the optimum window function and the processing proceeds to step S17.

In step S17, the window selecting part 59 generates the window function information SW[J] representing the window function WF1 selected as the optimum window function, and supplies the same to the frequency spectrum selecting part 60.

In step S18, the window selecting part 59 determines the coded normalization coefficient HSF1[J] supplied from the normalization coefficient coding part 54 as the coded normalization coefficient HSF[J]; the normalization coefficient SF1[J] as the normalization coefficient SF[J]; and the bit number NSF1[J] as the bit number NSF[J]. The window selecting part 59 supplies the coded normalization coefficient HSF[J] to the multiplexing part 61; the normalization coefficient SF[J] to the normalizing part 15; and the bit number NSF[J] to the quantizing part 16.

In step S19, the frequency spectrum selecting part 60 selects the frequency spectrum SP1[J] supplied from the frequency converting part 52 based on the window function information SW[J] supplied from the window selecting part 59, and supplies the same to the normalizing part 15 as the frequency spectrum SP[J]. Also, the frequency spectrum selecting part 60 supplies the window function information SW[J] to the multiplexing part 61. Then, the processing proceeds to step S23.

On the other hand, when it is determined that the bit number NSF1[J] is not smaller than the bit number NSF2[J] in step S16, the window selecting part 59 selects the window function WF2 as the optimum window function, and the processing proceeds to step S20.

In step S20, the window selecting part 59 generates the window function information SW[J] representing the window function WF2 selected as the optimum window function, and supplies the same to the frequency spectrum selecting part 60.

In step S21, the window selecting part 59 determines the coded normalization coefficient HSF2[J] supplied from the normalization coefficient coding part 58 as the coded normalization coefficient HSF[J]; the normalization coefficient SF2[J] as the normalization coefficient SF[J]; and the bit number NSF2[J] as the bit number NSF[J]. The window selecting part 59 supplies the coded normalization coefficient HSF[J] to the multiplexing part 61; the normalization coefficient SF[J] to the normalizing part 15; and the bit number NSF[J] to the quantizing part 16.

In step S22, the frequency spectrum selecting part 60 selects the frequency spectrum SP2[J] supplied from the frequency converting part 56 based on the window function information SW[J] supplied from the window selecting part 59, and supplies the same to the normalizing part 15 as the frequency spectrum SP[J]. Also, the frequency spectrum selecting part 60 supplies the window function information SW[J] to the multiplexing part 61. Then, the processing proceeds to step S23.

In step S23, the normalizing part 15 normalizes the frequency spectrum SP[J] supplied from the frequency spectrum selecting part 60 by using the normalization coefficient SF[J] supplied from the window selecting part 59, and supplies the resultant normalized spectrum NSP[J] to the quantizing part 16.

In step S24, the quantizing part 16 quantizes the normalized spectrum NSP[J] supplied from the normalizing part 15 based on the quantization information P[J], and supplies the resultant quantization spectrum QSP[J] to the coding part 17.

At this time, the coding part 17 calculates the bit number NQSP[J] necessary for coding the quantization spectrum QSP[J] supplied from the quantizing part 16. Here, when the bit number NB[J] of the code string B[J] is predetermined, it is necessary that the bit number NQSP[J] is a value NQ' or less as a result that the bit number NB[J] is subtracted by the bit number NP[J] of the quantization information P[J], the bit number NSF[J] necessary for coding the normalization coefficient SF[J] and the bit number of the window function information SW[J]. In this embodiment, since there are two different window functions, the bit number of the window function information SW[J] is 1 bit. The coding part 17 feeds back the bit number NQSP[J] to the quantizing part 16. The quantizing part 16 adjusts the quantization information P[J] so that the bit number NQSP[J] is equal to the value NQ' or less. The quantizing part 16 supplies the adjusted quantization information P[J] to the multiplexing part 61.

In step S25, the coding part 17 codes the quantization spectrum QSP[J] supplied from the quantizing part 16, and supplies the resultant coded spectrum HSP[J] to the multiplexing part 61.

In step S26, the multiplexing part 61 multiplexes the coded normalization coefficient HSF[J] from the window selecting part 59, the window function information SW[J] from the frequency spectrum selecting part 60, the quantization information P[J] from the quantizing part 16 and the coded spectrum HSP[J] from the coding part 17. The multiplexing part 61 transmits the resultant code string B[J] and terminates the processing.

As described above, the audio coding device 50 multiplies the frame data T[J] by the window function WF1 and the window function WF2 each having different characteristic, selects the window function WF1 or the window function WF2 as the optimum window function based on the resultant multiplied data, and transmits the coded spectrum of the multiplied data multiplied by the optimum window function as a coding result. Therefore, the audio coding device 50 selects, for example, a window function of a smaller bit number in the bit numbers necessary for coding the normalization coefficient of the frame data T[J] each multiplied by the window function WF1 and the window function WF2 as the optimum window function. Thereby, it is possible to code the audio signal by using the optimum window function for reducing the deterioration of sound quality.

[Configuration Example of the Audio Decoding Device]

Figure 9:
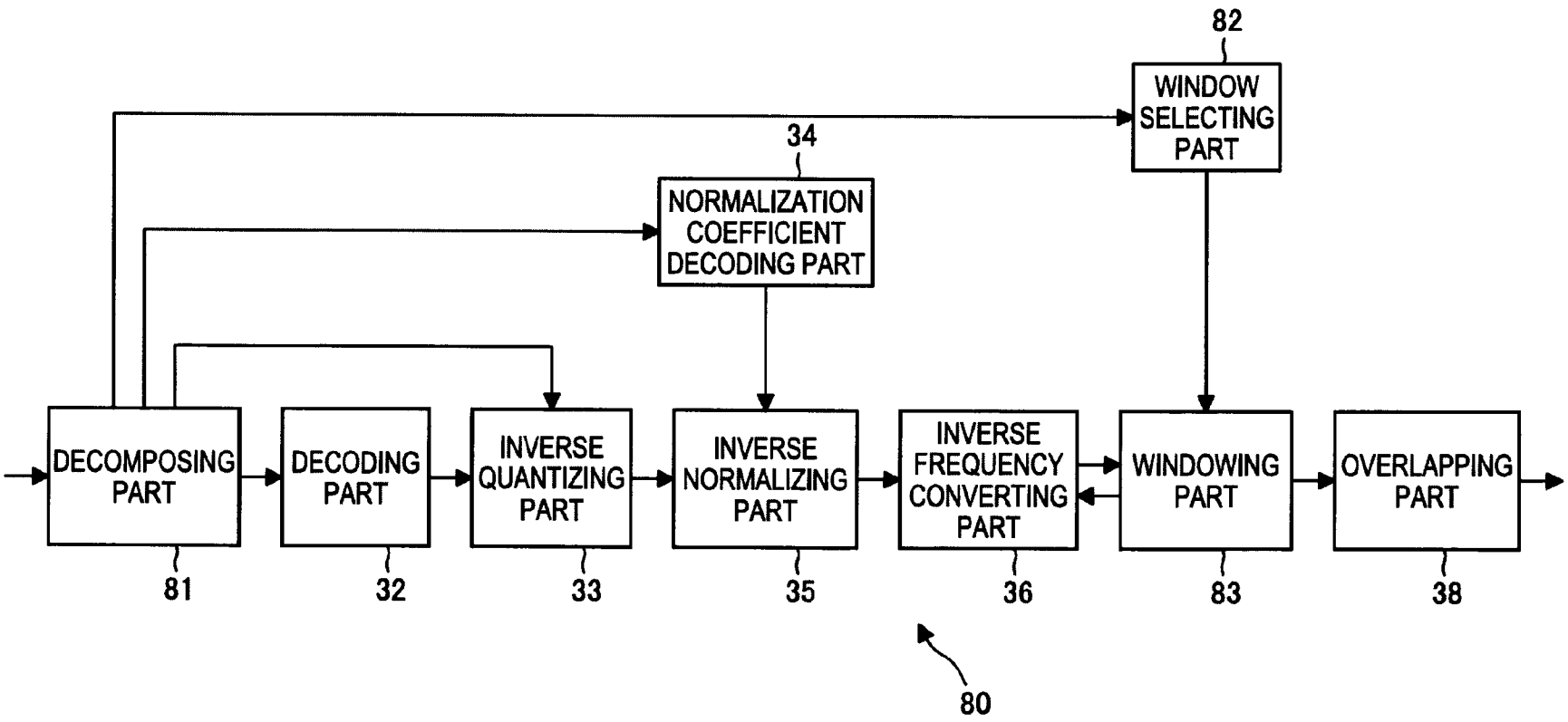
FIG. 9 is a block diagram showing a configuration example of an audio decoding device corresponding to the audio coding device shown FIG. 3.

FIG. 9 is a block diagram showing a configuration example of an audio decoding device which decodes a code string B[J] transmitted from the audio coding device 50 shown FIG. 3.

Figure 2:
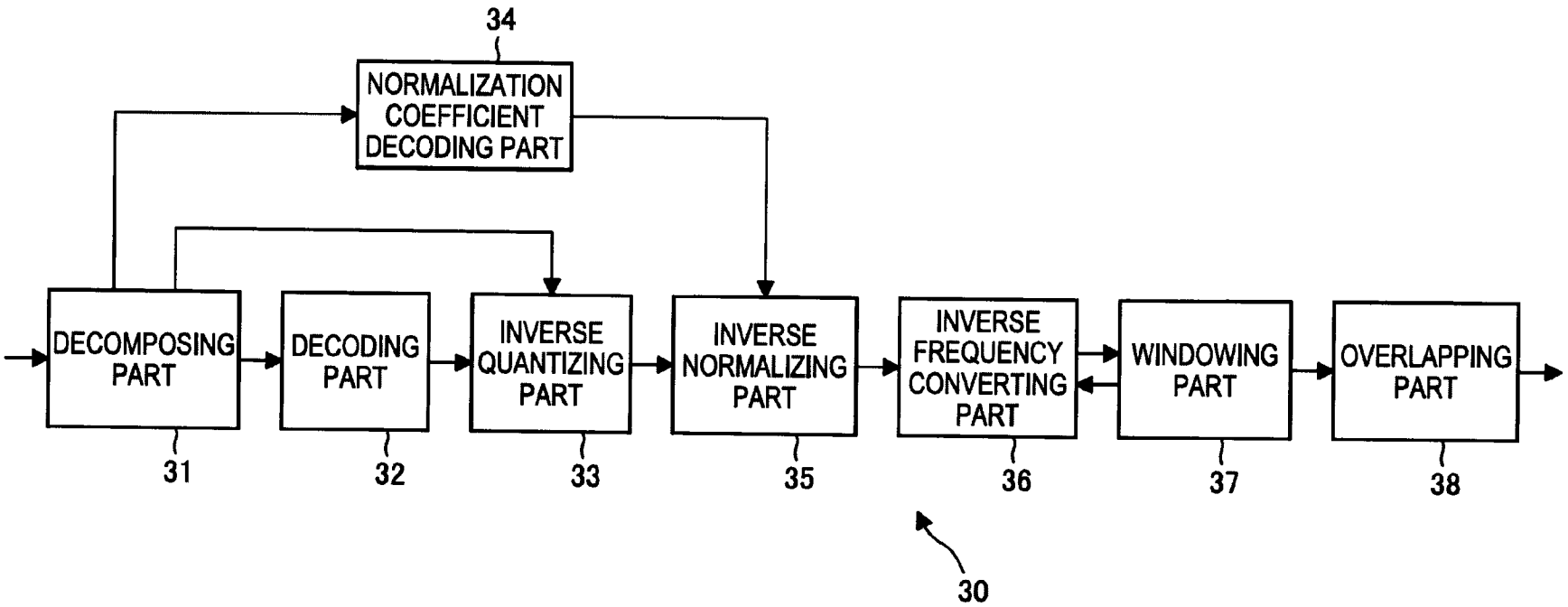
FIG. 2 is a block diagram showing an example of a configuration of a known audio decoding device.

In the configuration shown in FIG. 9, the same components as those shown in FIG. 2 are given with the same numerals, and duplicated descriptions will be appropriately omitted.

The configuration of an audio decoding device 80 in FIG. 9 is different from the configuration shown in FIG. 2 in a point that a decomposing part 81 and a windowing part 83 are provided in place of the decomposing part 31 and the windowing part 37, and a point that a window selecting part 82 is additionally provided.

The audio decoding device 80 selects the window function corresponding to the window function WF1 or the window function WF2 based on the window function information SW[J] included in the code string B[J] transmitted by the audio coding device 50, and multiplies the time axis data ST[J] by the window function.

In particular, the decomposing part 81 of the audio decoding device 80 functions as a receiving part to receive the code string B[J] transmitted from the audio coding device 50 shown FIG. 3. The decomposing part 81 decomposes the code string B[J] into the coded spectrum HSP[J], the quantization information P[J], the coded normalization coefficient HSF[J] and the window function information SW[J]. The decomposing part 81 supplies coded spectrum HSP[J] to the decoding part 32; the quantization information P[J] to the inverse quantizing part 33; the coded normalization coefficient HSF[J] to the normalization coefficient decoding part 34; and the window function information SW[J] to the window selecting part 82.

The window selecting part 82 selects the window function WB1 corresponding to the window function WF1 or the window function WB2 corresponding to the window function WF2 based on the window function information SW[J] supplied from the decomposing part 81. The relationship between the window function WF1 and the window function WB1; and the relationship between the window function WF2 and the window function WB2 has a restraint condition that, when the quantization bit number is infinite, the frame data T[J] input in the audio coding device 50 and the frame data T[J] output from the audio decoding device 80 coincide with each other. The window selecting part 82 supplies the selected window function to the windowing part 83 as the window function WB.

The windowing part 83 multiplies the time axis data ST[J] supplied from the inverse frequency converting part 36 by the window function WB supplied from the window selecting part 82, and supplies the multiplied data WBT[J] obtained as a multiplication result to the overlapping part 38.

[Description of the Processing in the Audio Decoding Device]

Figure 10:
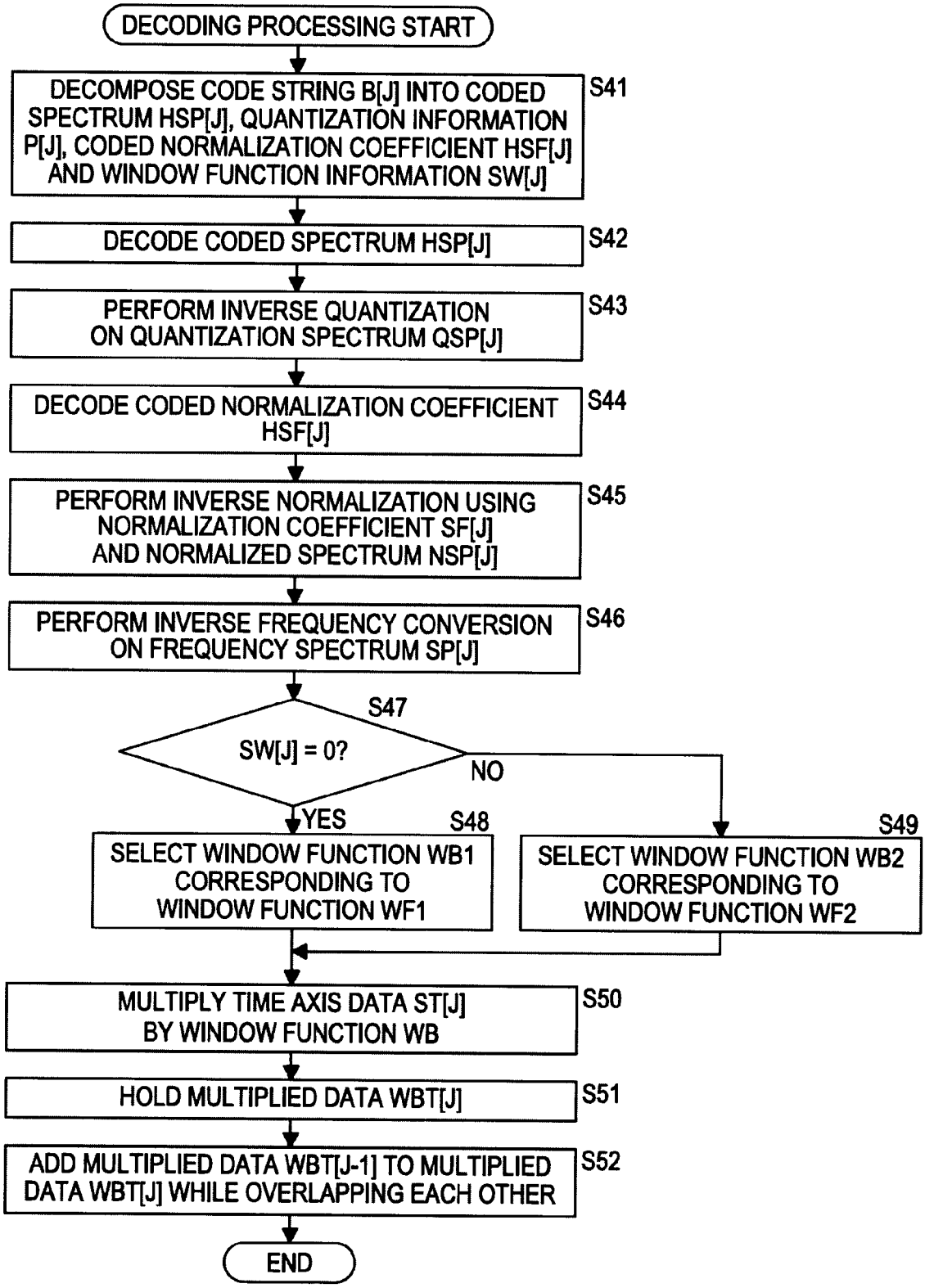
FIG. 10 is a flowchart explaining decoding processing of the audio decoding device shown in FIG. 9.

FIG. 10 is a flowchart explaining the decoding processing made by the audio decoding device 80 shown in FIG. 9. The decoding processing starts when, for example, the code string B[J] is transmitted from the audio coding device 50.

Referring to FIG. 10, in step S41, the decomposing part 81 included in the audio decoding device 80 receives the code string B[J] transmitted from the audio coding device 50 shown FIG. 3, and decomposes the same into the coded spectrum HSP[J], the quantization information P[J], the coded normalization coefficient HSF[J] and the window function information SW[J]. The decomposing part 81 supplies the coded spectrum HSP[J] to the decoding part 32; the quantization information P[J] to the inverse quantizing part 33; the coded normalization coefficient HSF[J] to the normalization coefficient decoding part 34; and the window function information SW[J] to the window selecting part 82.

In step S42, the decoding part 32 decodes the coded spectrum HSP[J] supplied from the decomposing part 81, and supplies the resultant quantization spectrum QSP[J] to the inverse quantizing part 33.

In step S43, the inverse quantizing part 33 performs an inverse quantization on the quantization spectrum QSP[J] supplied from the decoding part 32 based on the quantization information P[J] supplied from the decomposing part 81 to obtain a normalized spectrum NSP[J]. The inverse quantizing part 33 supplies the normalized spectrum NSP[J] to the inverse normalizing part 35.

In step S44, the normalization coefficient decoding part 34 decodes the coded normalization coefficient HSF[J] supplied from the decomposing part 81, and supplies the resultant normalization coefficient SF[J] to the inverse normalizing part 35.

In step S45, the inverse normalizing part 35 performs an inverse normalization by using the normalization coefficient SF[J] supplied from the normalization coefficient decoding part 34 and the normalized spectrum NSP[J], and supplies the resultant frequency spectrum SP[J] to the inverse frequency converting part 36.

In step S46, the inverse frequency converting part 36 performs an inverse frequency conversion on the frequency spectrum SP[J] supplied from the inverse normalizing part 35, and supplies the resultant time axis data ST[J] to the windowing part 83.

In step S47, the window selecting part 82 determines if the window function information SW[J] supplied from the decomposing part 81 is 0. When it is determined that the window function information SW[J] is 0 in step S47, in step S48, the window selecting part 82 selects the window function WB1 corresponding to the window function WF1 and supplies the same to the windowing part 83 as the window function WB. Then, the processing proceeds to step S50.

On the other hand, when it is determined that the window function information SW[J] is not 0 in step S47; i.e., when the window function information SW[J] is 1, in step S49, the window selecting part 82 selects the window function WB2 corresponding to the window function WF2, and supplies the same to the windowing part 83 as the window function WB. Then, the processing proceeds to step S50.

In step S50, the windowing part 83 multiplies the time axis data ST[J] supplied from the inverse frequency converting part 36 by the window function WB, and supplies the multiplied data WBT[J] obtained as a multiplication result to the overlapping part 38.

In step S51, the overlapping part 38 holds the multiplied data WBT[J] supplied from the windowing part 83.

In step S52, the overlapping part 38 adds a held multiplied data WBT[J−1] of a frame index J−1 to the multiplied data WBT[J] while overlapping, for example, a half of one frame with each other. The overlapping part 38 outputs the resultant frame data T[J] as the decoding result and terminates the processing.

Second Embodiment

Configuration Example of Coding Device

Figure 11:
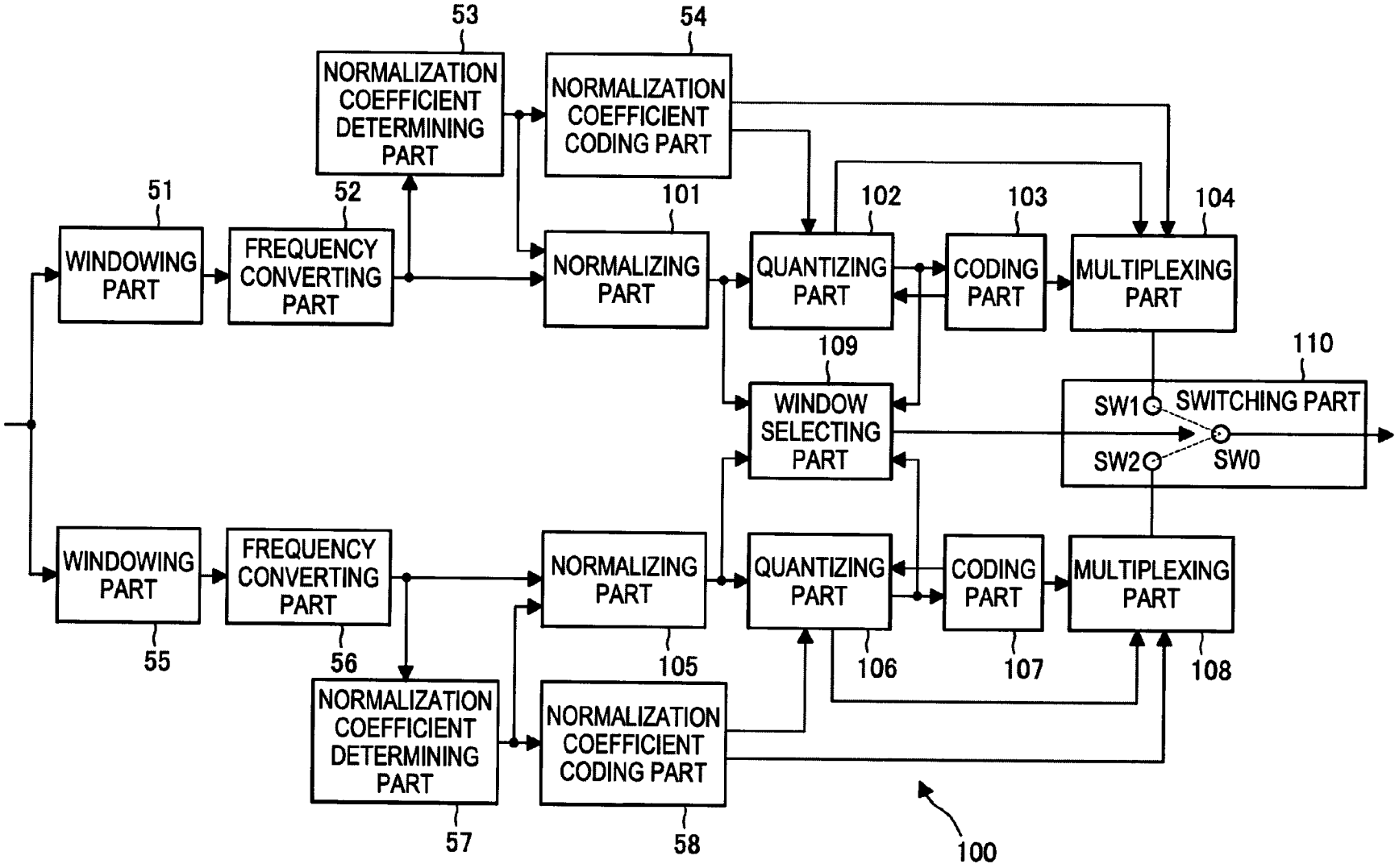
FIG. 11 is a block diagram showing a configuration example of a second embodiment of the audio coding device to which the present technology is applied.

FIG. 11 is a block diagram showing a configuration example of a second embodiment of the audio coding device to which the present technology is applied.

In the configuration shown in FIG. 11, the components identical to those shown in FIG. 3 are given with the same numeral, and duplicated description will be appropriately omitted.

The configuration of an audio coding device 100 shown in FIG. 11 is different from the configuration shown in FIG. 3 mainly in the following point that normalizing part 101 and 105, quantizing part 102 and 106, coding part 103 and 107, and multiplexing part 104 and 108 are provided in place of the normalizing part 15, the quantizing part 16, the coding part 17 and the multiplexing part 61; and a point that a window selecting part 109 and a switching part 110 are additionally provided. The audio coding device 100 is configured to select an optimum window function based on a quantization error.

In particular, a path 1' of the audio coding device 100 including the windowing part 51, the frequency converting part 52, the normalization coefficient determining part 53, the normalization coefficient coding part 54, the normalizing part 101, the quantizing part 102, the coding part 103 and the multiplexing part 104 is configured to obtain a code string B1[J] of the frame data T[J] multiplied by the window function WF1.

In more particular, the normalizing part 101 normalizes the frequency spectrum SP1[J] supplied from the frequency converting part 52 by using the normalization coefficient SF1[J] determined by the normalization coefficient determining part 53, and supplies a resultant spectrum NSP1[J] to the quantizing part 102 and the window selecting part 109.

The quantizing part 102 quantizes the spectrum NSP1[J] supplied from the normalizing part 101 based on the quantization information P1[J], and supplies a resultant quantization spectrum QSP1[J] to the coding part 103 and the window selecting part 109. At this time, the quantizing part 102 obtains a bit number NQSP1[J] fed back from the coding part 103 corresponding to the quantization spectrum QSP1[J], and adjusts the quantization information P1[J] so that the bit number NQSP1[J] becomes a predetermined value. The quantizing part 102 supplies the adjusted quantization information P1[J] to the multiplexing part 104.

The coding part 103 calculates the bit number NQSP1[J] necessary for coding the quantization spectrum QSP1[J] supplied from the quantizing part 102. Here, when the bit number NB[J] of the code string B[J] is predetermined, it is necessary that the bit number NQSP1[J] is a value NQ1 or less as a result that the bit number NB[J] is subtracted by the bit number NP1[J] of the quantization information P1[J], the bit number NSF1[J] necessary for coding the normalization coefficient SF1[J] calculated by the normalization coefficient coding part 54 and the bit number of the window function information SW[J]. Therefore, the coding part 103 supplies the bit number NQSP1[J] to the quantizing part 102, and the quantizing part 102 adjusts the quantization information P1[J] so that the bit number NQSP1[J] is the value NQ1 or less. Also, the coding part 103 codes the quantization spectrum QSP1[5] and supplies the resultant coded spectrum HSP1[J] to the multiplexing part 104.

The multiplexing part 104 multiplexes the coded normalization coefficient HSF1[J] from the normalization coefficient coding part 54, the quantization information P1[J] from the quantizing part 102 and the coded spectrum HSP1[J] from the coding part 103, and supplies the resultant code string B1[J] to the switching part 110.

A path 2' including the windowing part 55, the frequency converting part 56, the normalization coefficient determining part 57, the normalization coefficient coding part 58, the normalizing part 105, the quantizing part 106, the coding part 107 and the multiplexing part 108 is configured identical to that in the path 1' to obtain a code string B2[J] of the frame data T[J] multiplied by the window function WF2.

In particular, the normalizing part 105 normalizes the frequency spectrum SP2[J] supplied from the frequency converting part 56 by using the normalization coefficient SF2[J] supplied from the normalization coefficient determining part 57, and supplies the resultant spectrum NSP2[J] to the quantizing part 106 and the window selecting part 109.

The quantizing part 106 quantizes the spectrum NSP2[J] supplied from the normalizing part 105 based on the quantization information P2[J], and supplies the resultant quantization spectrum QSP2[J] to the coding part 107 and the window selecting part 109. At this time, the quantizing part 106 obtains the bit number NQSP2 fed back from the coding part 107 corresponding to the quantization spectrum QSP2[J], and adjusts the quantization information P2[J] so that the bit number NQSP2 becomes a predetermined value. The quantizing part 106 supplies the adjusted quantization information P2[J] to the multiplexing part 108.

The coding part 107 calculates a bit number NQSP2[J] necessary for coding the quantization spectrum QSP2[J] supplied from the quantizing part 106. Here, when the bit number NB[J] of the code string B[J] is predetermined, it is necessary that the bit number NQSP2[J] is the value NQ2 or less as a result that the bit number NB[J] is subtracted by the bit number NP1[J] of the quantization information P2[J], the bit number NSF2[J] necessary for coding of the normalization coefficient SF2[J] calculated by the normalization coefficient coding part 58 and the bit number of the window function information SW[J]. Therefore, the coding part 107 supplies the bit number NQSP2[J] to the quantizing part 106, and the quantizing part 106 adjusts the quantization information P2[J] so that the bit number NQSP2[J] is the value NQ2 or less. Also, the coding part 107 codes the quantization spectrum QSP2[J] and supplies the resultant coded spectrum HSP2[J] to the multiplexing part 108.

The multiplexing part 108 multiplexes the coded normalization coefficient HSF2[J] from the normalization coefficient coding part 58, the quantization information P2[J] from the quantizing part 106 and the coded spectrum HSP2[J] from the coding part 107, and supplies the resultant code string B2[J] to the switching part 110.

The window selecting part 109 performs an inverse quantization on the quantization spectrum QSP1[J] supplied from the quantizing part 102 same as the inverse quantizing part 33 of the audio decoding device 80 to generate a spectrum NSP1'[J]. Thus, the window selecting part 109 compares the spectrum NSP1'[J] with the original spectrum NSP1[J] supplied from the normalizing part 101 to obtain a quantization error D1[J]. In particular, the window selecting part 109 adds the difference between the spectrum NSP1'[J] and the spectrum NSP1[J] for each spectrum over full spectrum to obtain the quantization error D1[J].

Likewise, the window selecting part 109 performs an inverse quantization on the quantization spectrum QSP2[J] supplied from the quantizing part 106, and obtains a quantization error D2[J] by using the resultant spectrum NSP2'[J] and the original spectrum NSP2[J] supplied from the normalizing part 105. The window selecting part 109 compares the quantization error D1[J] and the quantization error D2[J], and selects the window function corresponding to the smaller one as the optimum window function. Then, the window selecting part 109 generates the window function information SW[J] representing the window function WF1 or the window function WF2 selected as the optimum window function, and supplies the same to the switching part 110.

The switching part 110 selects the code string B1[J] supplied from the multiplexing part 104 or the code string B2[J] supplied from the multiplexing part 108 based on window function information SW[J] supplied from the window selecting part 109. The switching part 110 multiplexes the window function information SW[J] on the selected code string. The switching part 110 functions as a transmitting part and controls the transmission of the code string B[J] obtained as a multiplex result and transmits the same.

[Description of the Processing of the Audio Coding Device]

Figure 12:
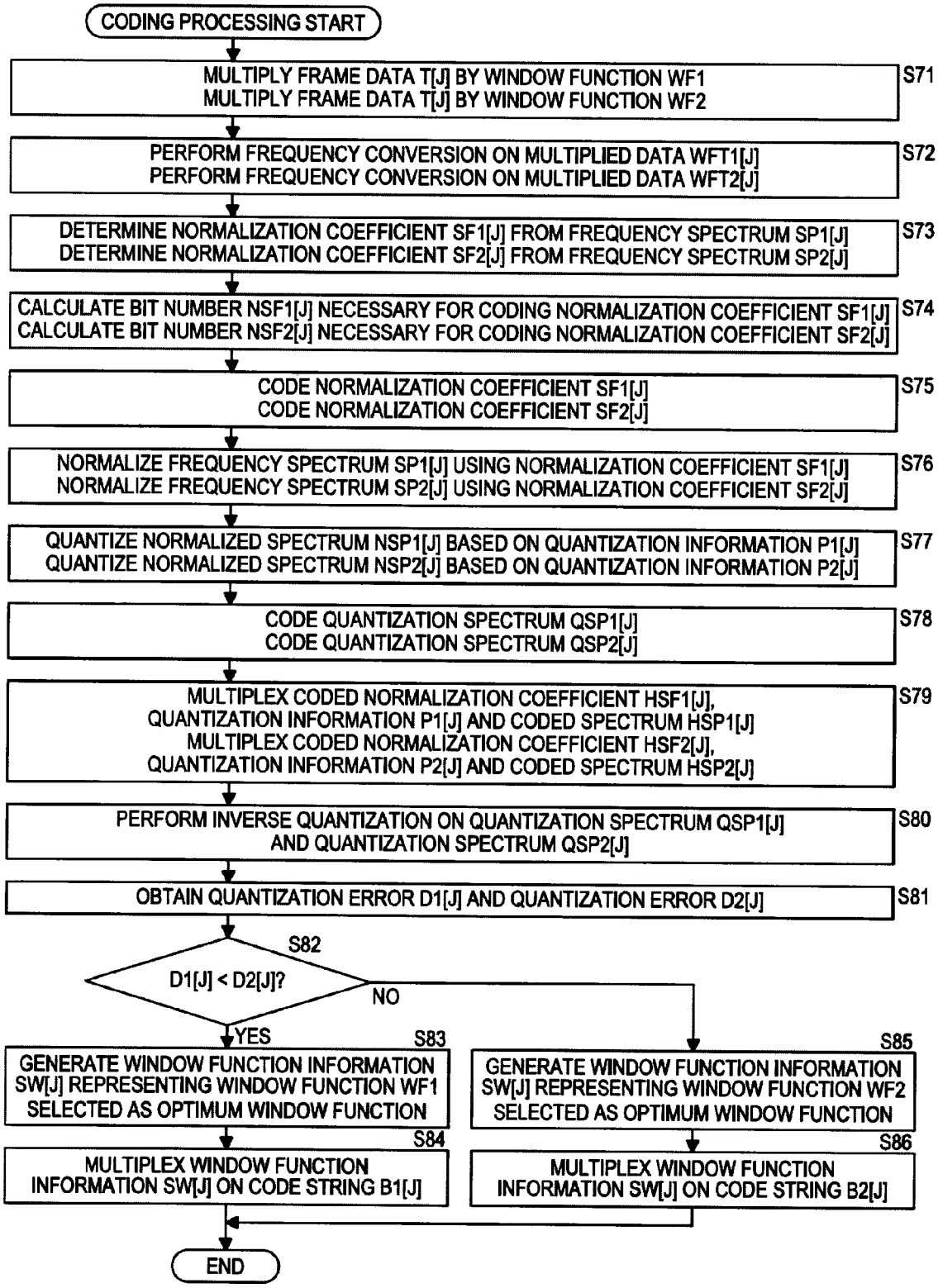
FIG. 12 is a flowchart explaining coding processing by the audio coding device shown in FIG. 11.

FIG. 12 is a flowchart explaining the coding processing made by the audio coding device 100 shown in FIG. 11. This coding processing starts when, for example, the frame data T[J] is input as a coding object.

Since the processing from step S71 to S75 in FIG. 12 is the identical to the processing from step S11 to S15 in FIG. 8, the description thereof is omitted.

After completing the processing in step S75, the normalizing part 101 normalizes the frequency spectrum SP1[J] supplied from the frequency converting part 52 by using the normalization coefficient SF1[J] supplied from the normalization coefficient determining part 53 in step S76. The normalizing part 101 supplies the resultant spectrum NSP1[J] to the quantizing part 102 and the window selecting part 109. Also, the normalizing part 105 normalizes the frequency spectrum SP2[J] supplied from the normalization coefficient determining part 57 by using the normalization coefficient SF2[J] supplied from the frequency converting part 56, and supplies the resultant spectrum NSP2[J] to the quantizing part 106 and the window selecting part 109.

In step S77, the quantizing part 102 quantizes the spectrum NSP1[J] supplied from the normalizing part 101 based on the quantization information P1[J], and supplies the resultant quantization spectrum QSP1[J] to the coding part 103 and the window selecting part 109.

At this time, the coding part 103 calculates the bit number NQSP1[J] necessary for coding the quantization spectrum QSP1[J] supplied from the quantizing part 102. The coding part 103 supplies the bit number NQSP1[J] to the quantizing part 102, and the quantizing part 102 adjusts the quantization information P1[J] so that the bit number NQSP1[J] becomes the value NQ1 or less. The quantizing part 102 supplies the adjusted quantization information P1[J] to the multiplexing part 104.

The quantizing part 106 quantizes the spectrum NSP2[J] supplied from the normalizing part 105 based on the quantization information P2[J], and supplies the resultant quantization spectrum QSP2[J] to the coding part 107 and the window selecting part 109.

At this time, the coding part 107 calculates the bit number NQSP2[J] necessary for coding the quantization spectrum QSP2[J] supplied from the quantizing part 106. The coding part 107 supplies the bit number NQSP2[J] to the quantizing part 106, and the quantizing part 106 adjusts the quantization information P2[J] so the bit number NQSP2[J] becomes the value NQ2 or less. The quantizing part 106 supplies the adjusted quantization information P2[J] to the multiplexing part 108.

In step S78, the coding part 103 codes the quantization spectrum QSP1[J], and supplies the resultant coded spectrum HSP1[J] to the multiplexing part 104. The coding part 107 codes the quantization spectrum QSP2[J], and supplies the resultant coded spectrum HSP2[J] to the multiplexing part 108.

In step S79, the multiplexing part 104 multiplexes the coded normalization coefficient HSF1[J] from the normalization coefficient coding part 54, the quantization information P1[J] from the quantizing part 102 and the coded spectrum HSP1[J] from the coding part 103. The multiplexing part 104 supplies the resultant code string B1[J] to the switching part 110. The multiplexing part 108 multiplexes the coded normalization coefficient HSF2[J] from the normalization coefficient coding part 58, the quantization information P2[J] from the quantizing part 106 and the coded spectrum HSP2[J] from the coding part 107, and supplies the resultant code string B2[J] to the switching part 110.

In step S80, the window selecting part 109 performs an inverse quantization on the quantization spectrum QSP1[J] supplied from the quantizing part 102 and the quantization spectrum QSP2[J]] supplied from the quantizing part 106 same as the inverse quantizing part 33 in the audio decoding device 80.

In step S81, the window selecting part 109 obtains the quantization error D1[J] and the quantization error D2[J]. In particular, the window selecting part 109 adds the spectrum NSP1'[J] obtained as result of the inverse quantization of the quantization spectrum QSP1[J] and the difference of each spectrum of the original spectrum NSP1[J] supplied from the normalizing part 101 in full spectrum and determines as the quantization error D1[J]. Also, the window selecting part 109 adds the spectrum NSP2'[J] obtained as a result of the inverse quantization of the quantization spectrum QSP2[J] and the difference of each spectrum of the original spectrum NSP2[J] supplied from the normalizing part 105 in full spectrum, and determines the quantization error D2[J].

In step S82, the window selecting part 109 determines if the quantization error D1[J] is smaller than the quantization error D2[J]. When it is determined that the quantization error D1[J] is smaller than the quantization error D2[J] in step S82, the window selecting part 109 selects the window function WF1 corresponding to the quantization error D1[J] as the optimum window function.

In step S83, the window selecting part 109 generates the window function information SW[J] representing the window function WF1 selected as the optimum window function, and supplies the same to the switching part 110.

In step S84, the switching part 110 selects the code string B1[J] supplied from the multiplexing part 104 based on the window function information SW[J] supplied from the window selecting part 109, and multiplexes the window function information SW[J] on the selected code string B1[J]. The switching part 110 transmits the resultant code string B[J], and terminates the processing.

On the other hand, when it is determined that the quantization error D1[J] is not smaller than the quantization error D2[J] in step S82, the window selecting part 109 selects the window function WF2 corresponding to the quantization error D2[J] as the optimum window function.

In step S85, the window selecting part 109 generates the window function information SW[J] representing the window function WF2 selected as the optimum window function, and supplies the same to the switching part 110.

In step S86, the switching part 110 selects the code string B2[J] supplied from the multiplexing part 108 and multiplexes the window function information SW[J] on the selected code string B2[J]. The switching part 110 transmits the resultant code string B[J], and terminates the processing.

As described above, the audio coding device 100 multiplies the frame data T[J] by the window function WF1 and the window function WF2 respectively each having different characteristic, selects the window function WF1 or the window function WF2 as the optimum window function based on the resultant multiplied data, and transmits the coded spectrum of the multiplied data multiplied by the optimum window function as the coding result. Therefore, the audio coding device 100 can code the audio signal using the optimum window function which reduces the deterioration of sound quality by selecting, for example, the window function having the smaller quantization error of the frame data T[J] multiplied by the window function WF1 and the window function WF2 as the optimum window function.

Although the audio coding device 100 obtains the quantization error by using the spectrum after the inverse quantization and the spectrum before quantization, the quantization error may be obtained by using the frequency spectrum before normalization, the spectrum after the inverse quantization and the frequency spectrum restored by using the normalization coefficient. In this case, the quantization error can be calculated more precisely.

Since the device for decoding the code string B[J] transmitted from the audio coding device 100 is the identical to the audio decoding device 80 shown in FIG. 9, the description thereof is omitted.

Third Embodiment

Explanation of Computer to which the Present Technology is Applied

Next, a series of the processing as mentioned above can be performed by either hardware or software. When the series of the processing is performed by software, a program constituting the software is installed in a general purpose computer or the like.

Figure 13:
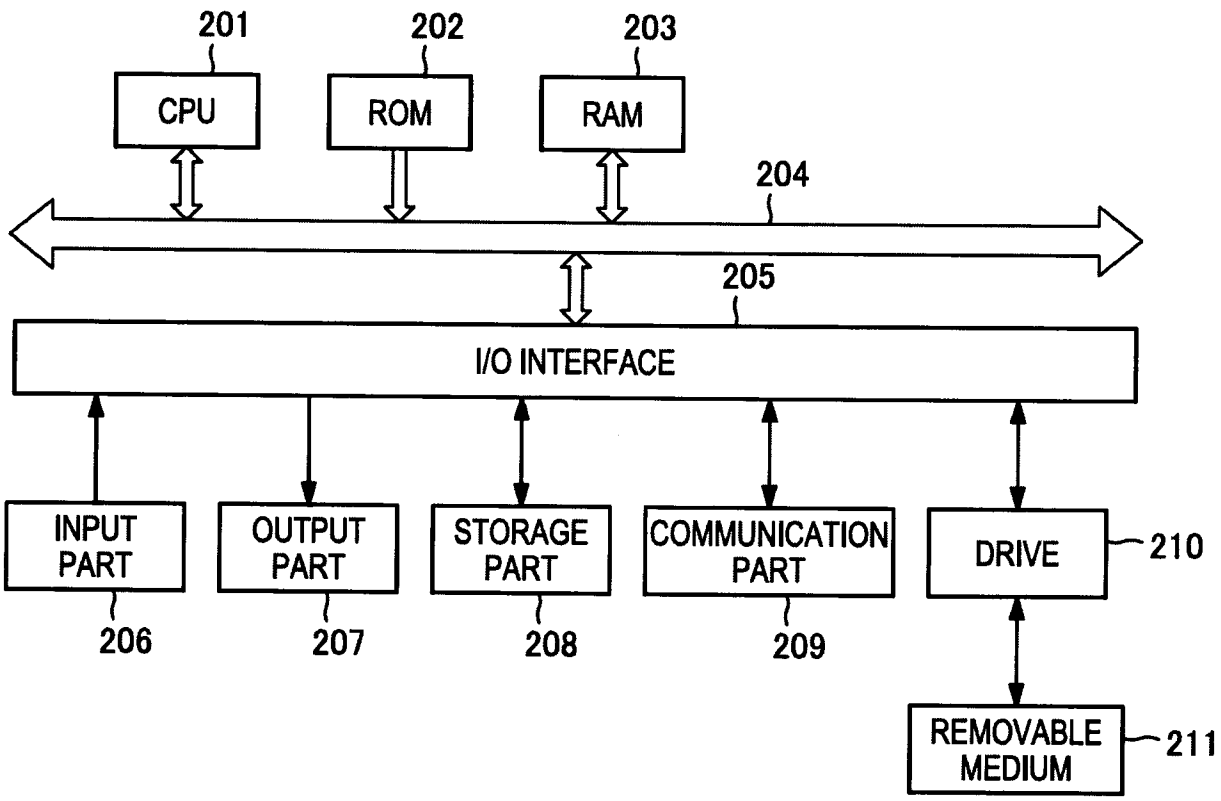
FIG. 13 illustrates a configuration example of an embodiment of a computer.

Thus, FIG. 13 illustrates a constitutional example according to one embodiment of a computer in which a program performing the above-mentioned series of processing is installed.

The program can previously be stored in a storage part 208 or an ROM (Read Only Memory) 202 as a recording medium built in a computer.

Or the program can be stored (recorded) in a removable medium 211. Such removable medium 211 can be provided as so-called package software. Here, as the removable medium 211 is, for example, a flexible disk, a CD-ROM (Compact Disc Read Only Memory), an MO (Magneto-Optical) disk, a DVD (Digital Versatile Disc), a magnetic disk, a semiconductor memory, or the like.

In addition, the program can be installed in the computer via a drive 210 from the removable medium 211 as mentioned above, or can be downloaded in the computer via a communication network or a broadcast network to be installed in the built-in storage part 208. That is, the program can be transferred to the computer by wireless communications, for example, via satellites for digital satellite broadcasting from download sites, or can be transferred to the computer by wired communications via a network such as an LAN (Local Area Network) and the Internet.

The computer includes a CPU (Central Processing Unit) 201 inside and to the CPU 201, an I/O interface 205 is connected via a bus 204.

When the CPU 201 receives commands inputted from a user via the I/O interface 205 by operations of an input part 206, according to the commands, it executes the program stored in the ROM 202. Or the CPU 201 loads the program stored in the storage part 208 in an RAM (Random Access Memory) 203 to execute it.

Thereby, the CPU 201 performs processing according to the above-mentioned flowcharts or processing which is performed according to the configuration of the above-mentioned block diagrams. Then, the CPU 201 outputs the processing result, for example, from an output part 207 via the I/O interface 205 as necessary for, or transmits it from a communication part 209, and in addition, records it in the storage part 208 or the like.

In addition, the input part 206 is configured to include a keyboard, a mouse, a microphone and the like. Moreover, the output part 207 is configured to include an LCD (Liquid Crystal Display), loudspeaker and the like.

Here, in the present specification, the processing which the computer performs according to the program is not necessarily performed chronologically in the order in which the flowcharts indicate. That is, the processing which the computer performs according to the program also includes processes performed in parallel or individually (for example, in parallel processing or object-oriented processing).

Moreover, the program may be processed by one computer (processor), or may be performed by plural computers in a distributed processing manner. Further, the program may be transferred to a remote computer to be executed.

It should be understood by those skilled in the art that various modifications, combinations, sub-combinations and alterations may occur depending on design requirements and other coefficients insofar as they are within the scope of the appended claims or the equivalents thereof.

Additionally, the present technology may also be configured as below.

(1) An audio coding device, including:

a first windowing part that multiplies an audio signal by a first window function;

a second windowing part that multiplies the audio signal by a second window function having a characteristic different from a characteristic of the first window function;

a window selecting part that selects the first window function or the second window function as an optimum window function based on the audio signal multiplied by the first windowing part and the audio signal multiplied by the second windowing part;

a coding part that codes a frequency spectrum of the audio signal multiplied by the optimum window function; and a transmitting part that transmits the frequency spectrum coded by the coding part and window function information representing the optimum window function.

(2) The audio coding device according to (1), further including:

a first normalization coefficient determining part that determines a normalization coefficient of a frequency spectrum of the audio signal multiplied by the first windowing part as a first normalization coefficient;

a second normalization coefficient determining part that determines a normalization coefficient of a frequency spectrum of the audio signal multiplied by the second windowing part as a second normalization coefficient;

a first normalization coefficient coding part that codes the first normalization coefficient determined by the first normalization coefficient determining part;

a second normalization coefficient coding part that codes the second normalization coefficient determined by the second normalization coefficient determining part; and a normalizing part that normalizes the frequency spectrum of the audio signal multiplied by the optimum window function by using the first normalization coefficient or the second normalization coefficient corresponding to the optimum window function, wherein the window selecting part selects the optimum window function based on a bit number necessary for coding the first normalization coefficient and the second normalization coefficient, the coding part codes the frequency spectrum normalized by the normalizing part, and the transmitting part transmits the coded frequency spectrum, a coding result of the first normalization coefficient or the second normalization coefficient corresponding to the optimum window function, and window function information representing the optimum window function.

(3) The audio coding device according to (1), further including:

a first quantizing part that quantizes a frequency spectrum of the audio signal multiplied by the first windowing part; and a second quantizing part that quantizes a frequency spectrum of the audio signal multiplied by the second windowing part;

wherein the window selecting part selects the optimum window function based on a first quantization error which is a quantization error of the frequency spectrum of the audio signal multiplied by the first windowing part and a second quantization error which is a quantization error of the frequency spectrum of the audio signal multiplied by the second windowing part, and the coding part codes the quantized frequency spectrum of the audio signal multiplied by the optimum window function.

(4) The audio coding device according to (3), wherein the window selecting part obtains the first quantization error based on a frequency spectrum of the audio signal multiplied by the first window function before quantization and the frequency spectrum quantized by the first quantizing part and inversely quantized, and obtains the second quantization error based on a frequency spectrum of the audio signal multiplied by the second window function before quantization and the frequency spectrum quantized by the second quantizing part and inversely quantized.

(5) An audio coding method performed by an audio coding device, including:

a first windowing step of multiplying an audio signal by a first window function;

a second windowing step of multiplying the audio signal by a second window function having a characteristic different from a characteristic of the first window function;

a window selecting step of selecting the first window function or the second window function as an optimum window function based on the audio signal multiplied by processing of the first windowing step and the audio signal multiplied by processing of the second windowing step;

a coding step of coding the frequency spectrum of the audio signal multiplied by the optimum window function; and a transiting step of transmitting the frequency spectrum coded by processing of the coding step and window function information representing the optimum window function.

(6) A program for causing a computer to perform processing including:

a first windowing step of multiplying an audio signal by a first window function;

a second windowing step of multiplying the audio signal by a second window function having a characteristic different from a characteristic of the first window function;

a window selecting step of selecting the first window function or the second window function as an optimum window function based on the audio signal multiplied by processing of the first windowing step and the audio signal multiplied by processing of the second windowing step;

a coding step of coding the frequency spectrum of the audio signal multiplied by the optimum window function; and a transmission controlling step of controlling the transmission of the frequency spectrum coded by processing of the coding step and of window function information representing the optimum window function.

(7) An audio decoding device, including:

a receiving part that receives a coded spectrum which is obtained as a result of coding a frequency spectrum of an audio signal multiplied by a first window function or a second window function having a characteristic different from a characteristic of the first window function as an optimum window function, and window function information representing the first window function or the second window function as the optimum window function;

a decoding part that decodes the coded spectrum received by the receiving part;

a window selecting part that selects the optimum window function from the first window function and the second window function based on the window function information received by the receiving part; and a windowing part that generates the audio signal from an audio signal of the frequency spectrum obtained as a result of decoding performed by the decoding part based on the optimum window function selected by the window selecting part.

(8) The audio decoding device according to (7), further including:

a normalization coefficient decoding part that decodes a coding result of a normalization coefficient used for normalizing the frequency spectrum of the audio signal multiplied by the optimum window function; and an inverse normalizing part that inversely normalizes the frequency spectrum obtained as the result of decoding performed by the decoding part by using the normalization coefficient decoded by the normalization coefficient decoding part, wherein the receiving part receives the coded spectrum obtained as a result of coding the frequency spectrum normalized by using the normalization coefficient, the coding result of the normalization coefficient, and the window function information, and the windowing part generates the audio signal from an audio signal of the frequency spectrum obtained as a result of inverse normalizing performed by the inverse normalizing part based on the optimum window function.

(9) The audio decoding device according to (7), further including an inverse quantizing part that inversely quantizes the frequency spectrum obtained as a result of decoding performed by the decoding part, wherein the receiving part receives the coded spectrum obtained as a result of coding the quantized frequency spectrum and the window function information, and the windowing part generates the audio signal from an audio signal of the frequency spectrum obtained as a result of inverse quantizing performed by the inverse quantizing part based on the optimum window function.

(10) An audio decoding method performed by an audio coding device, including:

a receiving step of receiving a coded spectrum which is obtained as a result of coding a frequency spectrum of an audio signal multiplied by a first window function or a second window function having a characteristic different from a characteristic of the first window function as an optimum window function and window function information representing the first window function or the second window function as the optimum window function;

a decoding step of decoding the coded spectrum received by processing of the receiving step;

a window selecting step of selecting the optimum window function from the first window function and the second window function based on the window function information received by the processing of the receiving step; and a windowing step of generating the audio signal from an audio signal of the frequency spectrum obtained as a result of decoding performed by processing of the decoding step based on the optimum window function selected by processing of the window selecting step.

(11) A program for causing a computer to perform processing including:

a reception controlling step of controlling reception of a coded spectrum which is obtained as a result of coding a frequency spectrum of an audio signal multiplied by a first window function or a second window function having a characteristic different from a characteristic of the first window function as an optimum window function and window function information representing the first window function or the second window function as the optimum window function;

a decoding step of decoding the coded spectrum received by processing of the reception controlling step;

a window selecting step of selecting the optimum window function from the first window function and the second window function based on the window function information received by the processing of the reception controlling step; and a windowing step of generating the audio signal from an audio signal of the frequency spectrum obtained as a result of decoding performed by processing of the decoding step based on the optimum window function selected by processing of the window selecting step.

The present disclosure contains subject matter related to that disclosed in Japanese Priority Patent Application JP 2011-209101 filed in the Japan Patent Office on Sep. 26, 2011, the entire content of which is hereby incorporated by reference.

What is claimed is:

1. An audio coding device, comprising:

a first windowing part that multiplies an audio signal by a first window function;

a second windowing part that multiplies the audio signal by a second window function having a characteristic different from a characteristic of the first window function;

a window selecting part that selects the first window function or the second window function as an optimum window function based on the audio signal multiplied by the first windowing part and the audio signal multiplied by the second windowing part;

a coding part that codes a frequency spectrum of the audio signal multiplied by the optimum window function; and a transmitting part that transmits the frequency spectrum coded by the coding part and window function information representing the optimum window function.

2. The audio coding device according to claim 1, further comprising:

a first normalization coefficient determining part that determines a normalization coefficient of a frequency spectrum of the audio signal multiplied by the first windowing part as a first normalization coefficient;

a second normalization coefficient determining part that determines a normalization coefficient of a frequency spectrum of the audio signal multiplied by the second windowing part as a second normalization coefficient;

a first normalization coefficient coding part that codes the first normalization coefficient determined by the first normalization coefficient determining part;

a second normalization coefficient coding part that codes the second normalization coefficient determined by the second normalization coefficient determining part; and a normalizing part that normalizes the frequency spectrum of the audio signal multiplied by the optimum window function by using the first normalization coefficient or the second normalization coefficient corresponding to the optimum window function, wherein the window selecting part selects the optimum window function based on a bit number necessary for coding the first normalization coefficient and the second normalization coefficient, the coding part codes the frequency spectrum normalized by the normalizing part, and the transmitting part transmits the coded frequency spectrum, a coding result of the first normalization coefficient or the second normalization coefficient corresponding to the optimum window function, and window function information representing the optimum window function.

3. The audio coding device according to claim 1, further comprising:

a first quantizing part that quantizes a frequency spectrum of the audio signal multiplied by the first windowing part; and a second quantizing part that quantizes a frequency spectrum of the audio signal multiplied by the second windowing part;

wherein the window selecting part selects the optimum window function based on a first quantization error which is a quantization error of the frequency spectrum of the audio signal multiplied by the first windowing part and a second quantization error which is a quantization error of the frequency spectrum of the audio signal multiplied by the second windowing part, and the coding part codes the quantized frequency spectrum of the audio signal multiplied by the optimum window function.

4. The audio coding device according to claim 3, wherein the window selecting part obtains the first quantization error based on a frequency spectrum of the audio signal multiplied by the first window function before quantization and the frequency spectrum quantized by the first quantizing part and inversely quantized, and obtains the second quantization error based on a frequency spectrum of the audio signal multiplied by the second window function before quantization and the frequency spectrum quantized by the second quantizing part and inversely quantized.

5. An audio coding method performed by an audio coding device, comprising:

a first windowing step of multiplying an audio signal by a first window function;

a second windowing step of multiplying the audio signal by a second window function having a characteristic different from a characteristic of the first window function;

a window selecting step of selecting the first window function or the second window function as an optimum window function based on the audio signal multiplied by processing of the first windowing step and the audio signal multiplied by processing of the second windowing step;

a coding step of coding the frequency spectrum of the audio signal multiplied by the optimum window function; and a transiting step of transmitting the frequency spectrum coded by processing of the coding step and window function information representing the optimum window function.

6. A non-transitory computer-readable medium storing a program which, when executed by a computer, causes the computer to perform processing including:

a first windowing step of multiplying an audio signal by a first window function;

a second windowing step of multiplying the audio signal by a second window function having a characteristic different from a characteristic of the first window function;

a window selecting step of selecting the first window function or the second window function as an optimum window function based on the audio signal multiplied by processing of the first windowing step and the audio signal multiplied by processing of the second windowing step;

a coding step of coding the frequency spectrum of the audio signal multiplied by the optimum window function; and a transmission controlling step of controlling the transmission of the frequency spectrum coded by processing of the coding step and of window function information representing the optimum window function.

7. An audio decoding device, comprising:

a receiving part that receives a coded spectrum which is obtained as a result of coding a frequency spectrum of an audio signal multiplied by a first window function or a second window function having a characteristic different from a characteristic of the first window function as an optimum window function, and window function information representing the first window function or the second window function as the optimum window function, wherein the optimum window function is determined based on the audio signal multiplied by the first window function and the audio signal multiplied by the second window function;

a decoding part that decodes the coded spectrum received by the receiving part;

a window selecting part that selects the optimum window function from the first window function and the second window function based on the window function information received by the receiving part; and a windowing part that generates the audio signal from an audio signal of the frequency spectrum obtained as a result of decoding performed by the decoding part based on the optimum window function selected by the window selecting part.

8. The audio decoding device according to claim 7, further comprising:

a normalization coefficient decoding part that decodes a coding result of a normalization coefficient used for normalizing the frequency spectrum of the audio signal multiplied by the optimum window function; and an inverse normalizing part that inversely normalizes the frequency spectrum obtained as the result of decoding performed by the decoding part by using the normalization coefficient decoded by the normalization coefficient decoding part, wherein the receiving part receives the coded spectrum obtained as a result of coding the frequency spectrum normalized by using the normalization coefficient, the coding result of the normalization coefficient, and the window function information, and the windowing part generates the audio signal from an audio signal of the frequency spectrum obtained as a result of inverse normalizing performed by the inverse normalizing part based on the optimum window function.

9. The audio decoding device according to claim 7, further comprising an inverse quantizing part that inversely quantizes the frequency spectrum obtained as a result of decoding performed by the decoding part, wherein the receiving part receives the coded spectrum obtained as a result of coding the quantized frequency spectrum and the window function information, and the windowing part generates the audio signal from an audio signal of the frequency spectrum obtained as a result of inverse quantizing performed by the inverse quantizing part based on the optimum window function.

10. An audio decoding method performed by an audio coding device, comprising:

a receiving step of receiving a coded spectrum which is obtained as a result of coding a frequency spectrum of an audio signal multiplied by a first window function or a second window function having a characteristic different from a characteristic of the first window function as an optimum window function and window function information representing the first window function or the second window function as the optimum window function, wherein the optimum window function is determined based on the audio signal multiplied by the first window function and the audio signal multiplied by the second window function;

a decoding step of decoding the coded spectrum received by processing of the receiving step;

a window selecting step of selecting the optimum window function from the first window function and the second window function based on the window function information received by the processing of the receiving step; and a windowing step of generating the audio signal from an audio signal of the frequency spectrum obtained as a result of decoding performed by processing of the decoding step based on the optimum window function selected by processing of the window selecting step.

11. A non-transitory computer-readable medium storing a program which, when executed by a computer, causes the computer to perform processing including:

a reception controlling step of controlling reception of a coded spectrum which is obtained as a result of coding a frequency spectrum of an audio signal multiplied by a first window function or a second window function having a characteristic different from a characteristic of the first window function as an optimum window function and window function information representing the first window function or the second window function as the optimum window function, wherein the optimum window function is determined based on the audio signal multiplied by the first window function and the audio signal multiplied by the second window function;

a decoding step of decoding the coded spectrum received by processing of the reception controlling step;

a window selecting step of selecting the optimum window function from the first window function and the second window function based on the window function information received by the processing of the reception controlling step; and a windowing step of generating the audio signal from an audio signal of the frequency spectrum obtained as a result of decoding performed by processing of the decoding step based on the optimum window function selected by processing of the window selecting step.

* * * * *